US009115579B2

(12) United States Patent
Schneider et al.

(10) Patent No.: US 9,115,579 B2
(45) Date of Patent: Aug. 25, 2015

(54) APPARATUS AND METHOD FOR DOWNHOLE STEAM GENERATION AND ENHANCED OIL RECOVERY

(71) Applicant: RESOURCE INNOVATIONS INC., Calgary (CA)

(72) Inventors: Fred Schneider, Calgary (CA); Lynn P Tessier, Eckville (CA)

(73) Assignee: R.I.I. NORTH AMERICA INC (CA)

( * ) Notice: Subject to any disclaimer, the term of this patent is extended or adjusted under 35 U.S.C. 154(b) by 271 days.

(21) Appl. No.: 13/629,114

(22) Filed: Sep. 27, 2012

(65) Prior Publication Data

US 2013/0020076 A1 Jan. 24, 2013

Related U.S. Application Data

(63) Continuation-in-part of application No. 12/687,711, filed on Jan. 14, 2010, now Pat. No. 8,333,239.

(60) Provisional application No. 61/560,468, filed on Nov. 16, 2011.

(51) Int. Cl.
*E21B 43/243* (2006.01)
*E21B 36/02* (2006.01)

(52) U.S. Cl.
CPC ..... *E21B 43/243* (2013.01); *E21B 36/02* (2013.01)

(58) Field of Classification Search
CPC ..... E21B 43/243; E21B 36/02; E21B 43/16; E21B 43/162; E21B 43/24
USPC ..... 166/256, 257, 261, 302, 59
See application file for complete search history.

(56) References Cited

U.S. PATENT DOCUMENTS

| | | | | |
|---|---|---|---|---|
| 3,513,913 | A * | 5/1970 | Bruist | 166/245 |
| 4,397,356 | A * | 8/1983 | Retallick | 166/303 |
| 4,493,369 | A * | 1/1985 | Odeh et al. | 166/261 |
| 4,776,638 | A * | 10/1988 | Hahn | 299/5 |
| 2005/0269095 | A1* | 12/2005 | Fairbanks | 166/302 |
| 2009/0159277 | A1* | 6/2009 | Hocking | 166/259 |

* cited by examiner

*Primary Examiner* — Brad Harcourt
(74) *Attorney, Agent, or Firm* — Goodwin Law; Sean W. Goodwin

(57) ABSTRACT

A burner is arranged for access to a cavity in a target zone of a hydrocarbon reservoir. The burner is operated into the cavity to create and sustain hot combustion gases at a steady state for flowing into and permeating through the target zone. Water is injected into the target zone and permeates laterally therein. The hot combustion gases and the water in the target zone interact to form a steam drive front in the hydrocarbon reservoir.

18 Claims, 18 Drawing Sheets

Fig. 7A
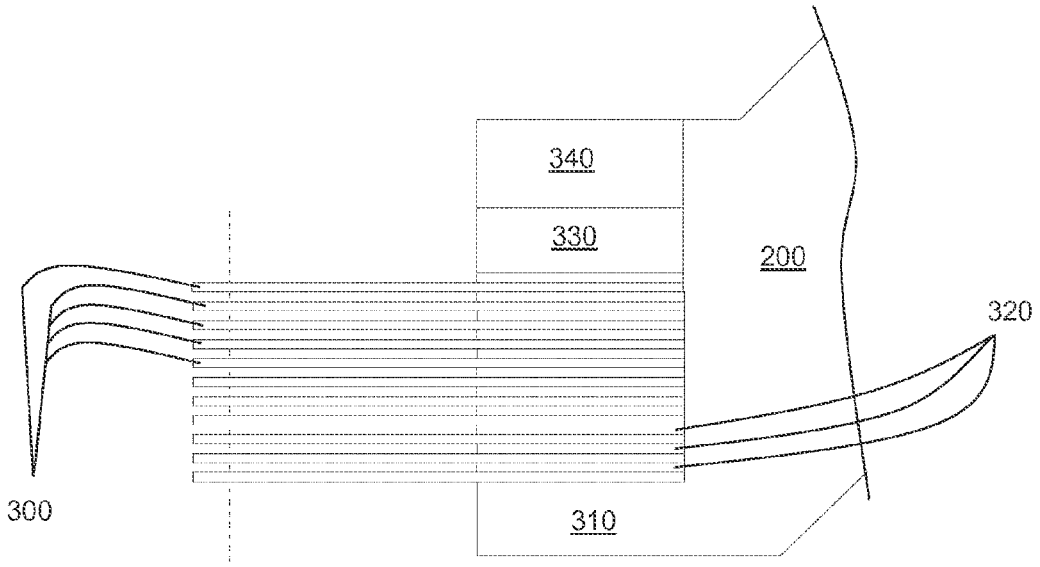
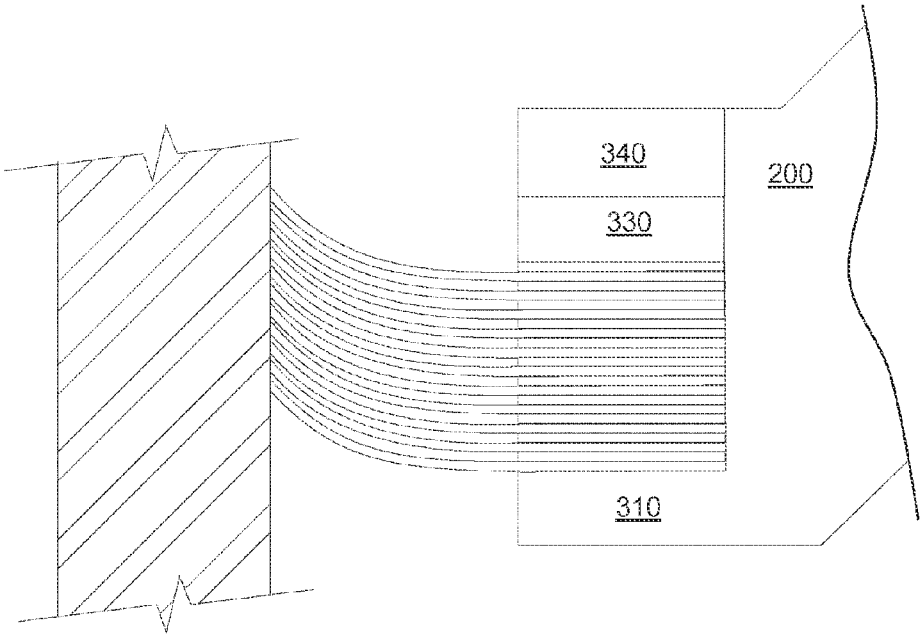
Fig. 7B

APPARATUS AND METHOD FOR DOWNHOLE STEAM GENERATION AND ENHANCED OIL RECOVERY

CROSS REFERENCE TO RELATED APPLICATIONS

This is a continuation-in-part application that claims the benefits under 35 U.S.C. 120 of the U.S. patent application Ser. No. 12/687,711, filed on Jan. 14, 2010, and published as US 2010/0181069 on Jul. 22, 2010, the entirety of which is incorporated fully herein by reference.

This application further claims the benefits under 35 U.S.C 119(e) of the U.S. Provisional Application Ser. No. 61/560,468, filed Nov. 16, 2011, the entirety of which is also incorporated fully herein by reference.

FIELD OF THE INVENTION

The present invention relates a method for creating a drive front in a target zone in a hydrocarbon reservoir for enhanced oil recovery. More specifically, a downhole burner is arranged to access a cavity in the target zone for creating hot gases which enter into the target zone. Water injected into the target zone forms a steam drive front hydrocarbon reservoir.

BACKGROUND OF THE INVENTION

It is known to conduct enhanced oil recovery (EOR) of hydrocarbons from subterranean hydrocarbon formations after primary recovery processes are no longer feasible. EOR include thermal methods such as in-situ combustion, steam flood, and miscible flooding which use various arrangements of stimulation or injection wells and production wells. In some techniques the stimulation and production wells may serve both duties. Other techniques include steam flooding, cyclic steam stimulation (CSS), in-situ combustion and steam assisted gravity drainage (SAGD). SAGD uses closely coupled, a horizontally-extending steam injection well forming a steam chamber for mobilizing heavy oil for recovery at a substantially parallel and horizontally-extending production well.

Thermal methods of EOR can only be implemented in wells that have been completed for thermal completions. Due to the high temperatures used in thermal completions, wells employing such EOR techniques must be completed using materials, such as steel and cement, that can withstand high temperatures. Wells that were not completed with such high temperature resistant materials cannot implement thermal completions for EOR. Accordingly, well operators must decide on whether or not to implement of thermal EOR and based on this decision complete a well using (or not) high temperature resistant materials.

U.S. Pat. No. 3,196,945 to Forrest et al (assigned to Pan American Petroleum Company) discloses a downhole process comprising a first igniting a reservoir and then injecting air or an equivalent oxygen containing gas in an amount sufficient to create a definite combustion zone or front, the front being at high temperature, typically 800-2400° F. Called forward combustion, Forrest contemplates an oxygen rich front for continued combustion. Demands for large air flow is reduced by co-injection of water or other suitable condensable fluid into the heated formation to create steam front that urges the movement of hydrocarbons or oil. Forrest can co-discharge water and air to the heated formation for creating high temperature steam.

U.S. Pat. No. 4,442,898 to Wyatt (assigned to Trans-Texas Energy Inc.) discloses a downhole vapor generator or burner. High pressure water in an annular sleeve around the burner combustion chamber within which an oxidant and fuel are combusted. The energy from the combustion vaporizes the water surrounding the combustion chamber, cooling the burner and also creating high temperature steam for injection into the formation.

U.S. Pat. No. 4,377,205 to Retallick discloses a catalytic low pressure combustor for generating steam downhole. The steam produced from the metal catalytic supports is conducted to steam generating tubes, and the steam is injected into the formation. Any combustion gases produced are vented to the surface.

U.S. Pat. No. 4,336,839 to Wagner et al (assigned to Rockwell International corp.) discloses a direct firing downhole steam generator comprising an injector assembly axially connected with a combustion chamber. The combustion products, including $CO_2$, are passed through a heat exchanger where they mix with pre-heated water and are ejected out of the generator into the formation through a nozzle.

U.S. Pat. No. 4,648,835 to Eisenhawer et al. (assigned to Enhanced Energy Systems) discloses a direct fire steam generator comprising a downhole burner employing a unique ignition technique using the gaseous injection of a pyrophoric compound such as triethylborane. Natural gas is burned and water is introduced to control combustion. The combustion products, like in Wagner are mixed with water and the resulting steam and other remaining combustion products are injected into the formation.

US Patent Application Publication 2007/0193748 to Ware et al (assigned to World Energy Systems, Inc.) discloses a downhole burner for producing hydrocarbons from a heavy-oil formation. Hydrogen, oxygen and steam are pumped by separate conduits to the burner. A portion of the hydrogen is combusted and the burner forces the combustion products out into the formation. Incomplete combustion is useful in suppressing the formation of coke. The injected steam cools the burner, thereby creating a super heated steam which is also injected into the formation along with the combustion products. $CO_2$ from the surface is also pumped downhole for heating and injection into the formation to solubilise in oil for reducing its viscosity.

In-situ processes to date have not successfully provided economic solutions and have not resolved issues of temperature management, corrosion, coking and overhead associated with existing surface equipment.

SUMMARY OF THE INVENTION

The present invention is an apparatus and method of creating a drive front in a hydrocarbon reservoir. The apparatus is positioned in a cased wellbore within a target zone in the hydrocarbon reservoir. The apparatus comprises a downhole burner fluidly connected to a tubing string extending downhole. The tubing string comprises a plurality of passages for at least fuel, and oxidant and water. The downhole burner creates a combustion cavity within the target reservoir zone by combusting the fuel and the oxidant, such as oxygen, at a temperature sufficient to melt the reservoir at the target zone or otherwise form a cavity below the downhole burner. Once the combustion cavity is created, the downhole burner operates at steady state for creating and sustaining hot combustion gases in the combustion cavity, which flow or permeate into the hydrocarbon reservoir. The hot combustion gases permeate away from the combustion cavity forming a gaseous drive front, transferring some of its heat to the rest of the reservoir.

Water is also injected into the target zone above the combustion cavity, which flow or permeate laterally into the reservoir adjacent the wellbore. In the reservoir, the water acts to cool the reservoir adjacent the wellbore, decreasing the amount of heat lost to the overburden. At an interface, the water and hot combustion gases combine to create a steam and gaseous drive front.

Further, the injection of water adjacent the wellbore also cools the cased wellbore, protecting the casing against the heat from the steam and hot combustion gases. Accordingly, the present invention is not limited to use only in thermally completed wells and can be implemented at any cased wellbore, whether or not the wellbore was completed for thermal EOR.

In a broad aspect of the invention, a process for creating a steam and gas drive front is disclosed. A downhole burner assembly, fluidly connected to a main tubing string, is positioned within a target zone in a hydrocarbon reservoir. The burner assembly creates a combustion cavity by combusting fuel and an oxidant at a temperature sufficient to melt the reservoir or otherwise create a cavity. The burner assembly then continues steady state combustion to create and sustain hot combustion gases for flowing and permeating into the reservoir for creating a gaseous drive front. Water is injected into the reservoir, uphole of the combustion cavity for creating a steam drive front.

In another broad aspect of the invention, a downhole steam generator for enhanced oil recovery from a hydrocarbon reservoir accessed by a cased and completed wellbore is disclosed. The downhole steam generator is a burner assembly positioned within the cased wellbore at the hydrocarbon reservoir, the burner assembly having a high temperature casing seal adapted for sealing a casing annulus between the downhole burner and the cased wellbore, and a means for injecting water into the hydrocarbon reservoir above the casing seal. The high temperature casing seal can pass through casing distortions, and is reusable, not being affected substantially by thermal cycling.

In another broad aspect of the invention, a system for creating a drive front in a hydrocarbon reservoir having a cased wellbore is disclosed. The system has a burner assembly having a downhole burner and a high temperature casing seal for sealing a casing annulus between the downhole burner and the casing of the cased wellbore. The high temperature casing seal can pass through casing distortions and is reusable, substantially not being affected by thermal cycling.

In another broad aspect of the invention, a system is provided for fluidly connecting three concentric passageways in a main tubing string to a downhole tool. The system has an outer housing, an intermediate mandrel and an inner mandrel. The outer housing is releaseably connected to the intermediate mandrel by an intermediate latch assembly and similarly, the inner mandrel is releaseably connected to the intermediate mandrel by an inner latch assembly. The intermediate mandrel is fit within the outer housing, forming an intermediate annulus therebetween, and is adapted to fluidly connect to an intermediate tubing string. The inner mandrel is fit within the intermediate mandrel, forming an inner annulus therebetween and is adapted to fluidly connect to an inner tubing string. The inner mandrel further has an inner bore.

In another broad aspect, a process for creating a drive front in a hydrocarbon reservoir for enhanced oil recovery is provided comprising arranging a burner assembly in a wellbore to access a cavity in a target zone in the hydrocarbon reservoir and directing combustion from the burner assembly into the cavity and sustaining hot combustion gases therein, the hot combustion gases entering into and permeating from the cavity to the heat the target zone. The process further comprises injecting water into the target zone, the water entering into and permeating into the target zone and interacting with the hot combustion gases therein for creating steam in the target zone, and forming a steam drive front in the hydrocarbon reservoir.

In another aspect, the cavity can be artificially created including mechanical, hydraulic or combustion operations or may be pre-existing, having been formed due to prior reservoir operations or be naturally occurring.

BRIEF DESCRIPTION OF THE FIGURES

FIG. 7A is a partial cross-sectional view of the nozzle and an embodiment of a brush-type casing seal of FIG. 3 with the casing omitted;

FIG. 7B illustrates an activated brush seal according to FIG. 7A and showing the stack of flexible brush rings flexing when constrained by the casing;

DETAILED DESCRIPTION OF THE INVENTION

Figure 1:
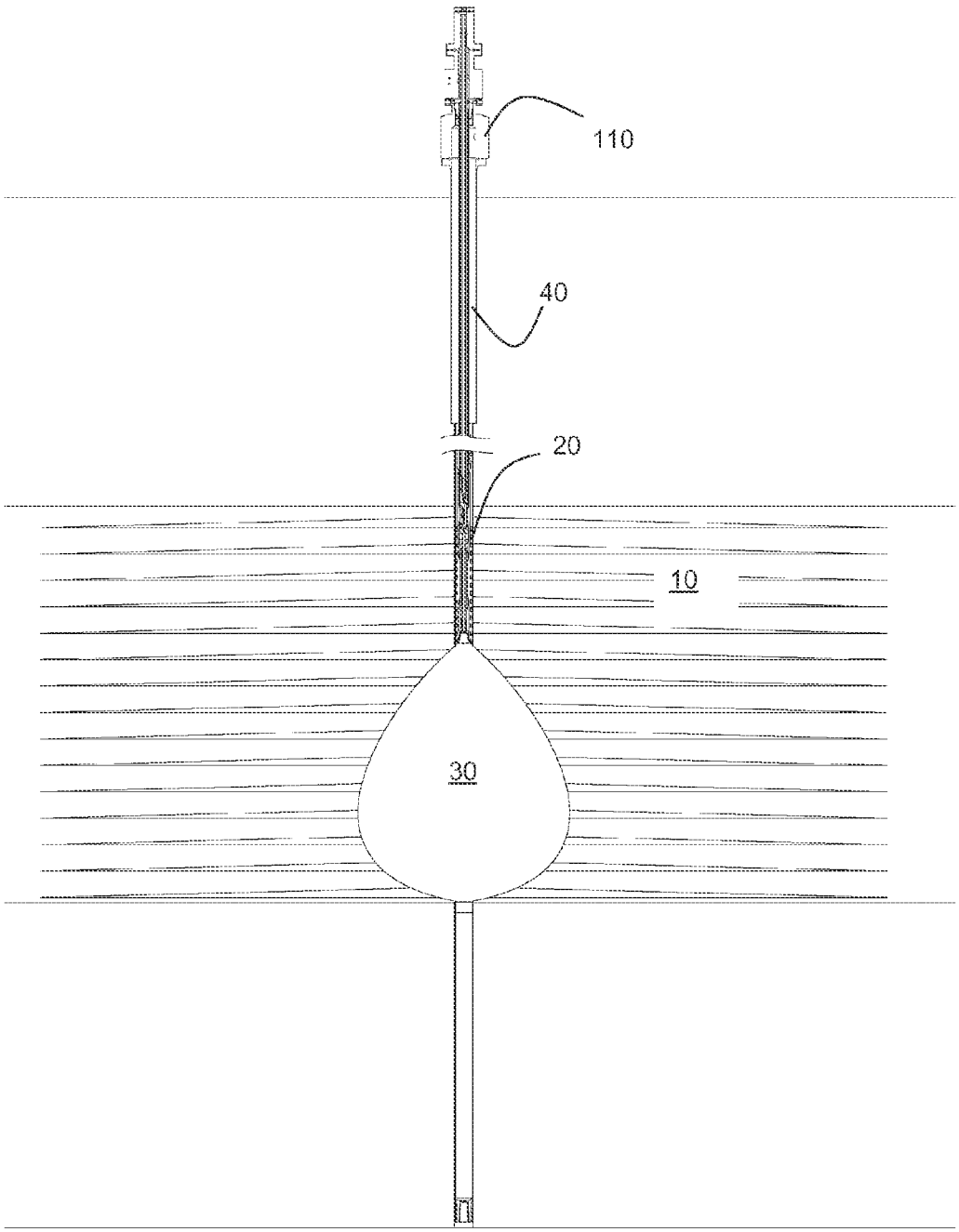
FIG. 1 is a side cross-sectional view of an embodiment of the present invention, illustrating a combustion cavity in a hydrocarbon reservoir, the cavity being created by downhole burner and formed for disseminating hot combustion gases for forming a gaseous drive front and interacting with water injected uphole of the cavity for forming an additional steam drive front.

As shown in FIG. 1, a thermal process utilizes a downhole production of heat, steam and hot combustion gases (primarily CO, $CO_2$, and $H_2O$) to best effect for the recovery of residual or otherwise intractable hydrocarbons from a hydrocarbon reservoir 10. A burner assembly 20 initially creates a combustion cavity 30 and then creates and sustains the creation of hot combustion gases, such as CO, $CO_2$, and $H_2O$. Addition of water to the reservoir 10 above the combustion cavity 30 results in the production of a steam drive front. The steam and hot combustion gases combine to create a steam and gaseous drive front.

Figure 2B:
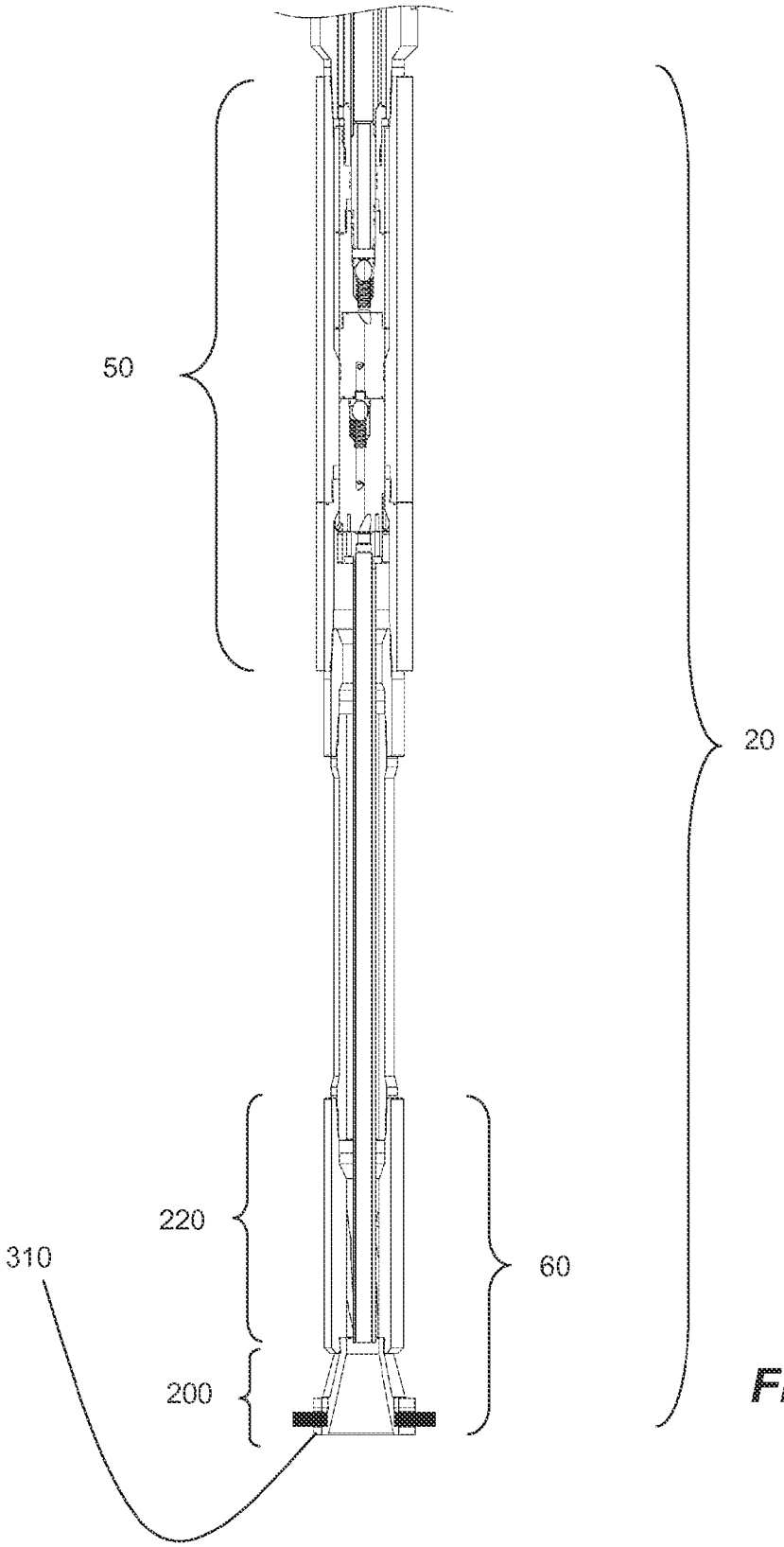
FIG. 2B is a side quarter-sectional elevation of the three tubing strings of FIG. 2A (casing omitted) and illustrating a main tubing string supporting the downhole burner at a burner interface assembly, the main tubing string having an intermediate and an inner tubing string disposed therein.
Figure 3:
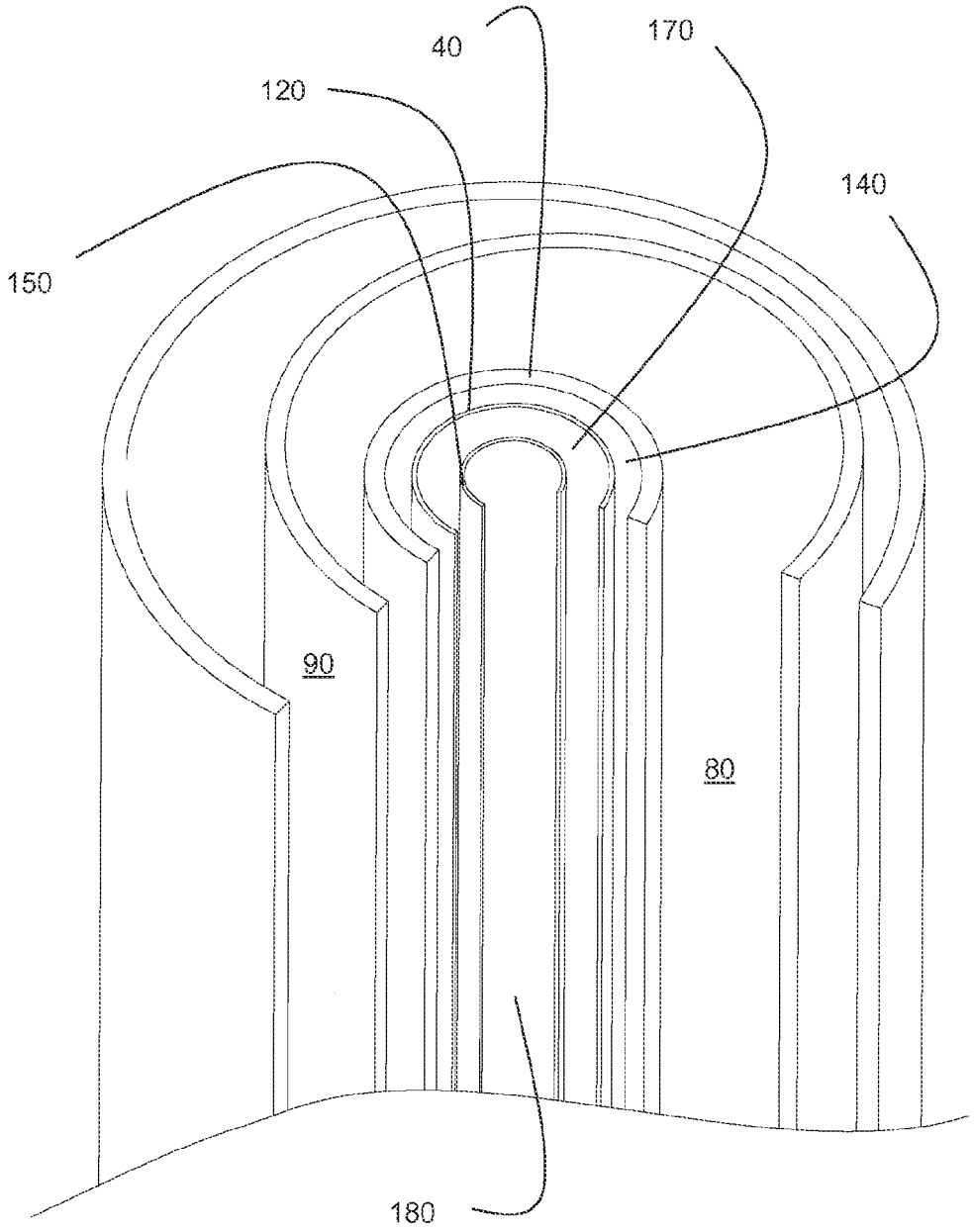
FIG. 3 illustrates a quarter-sectional, perspective view across the casing and three concentric tubing strings.
Figure 4:
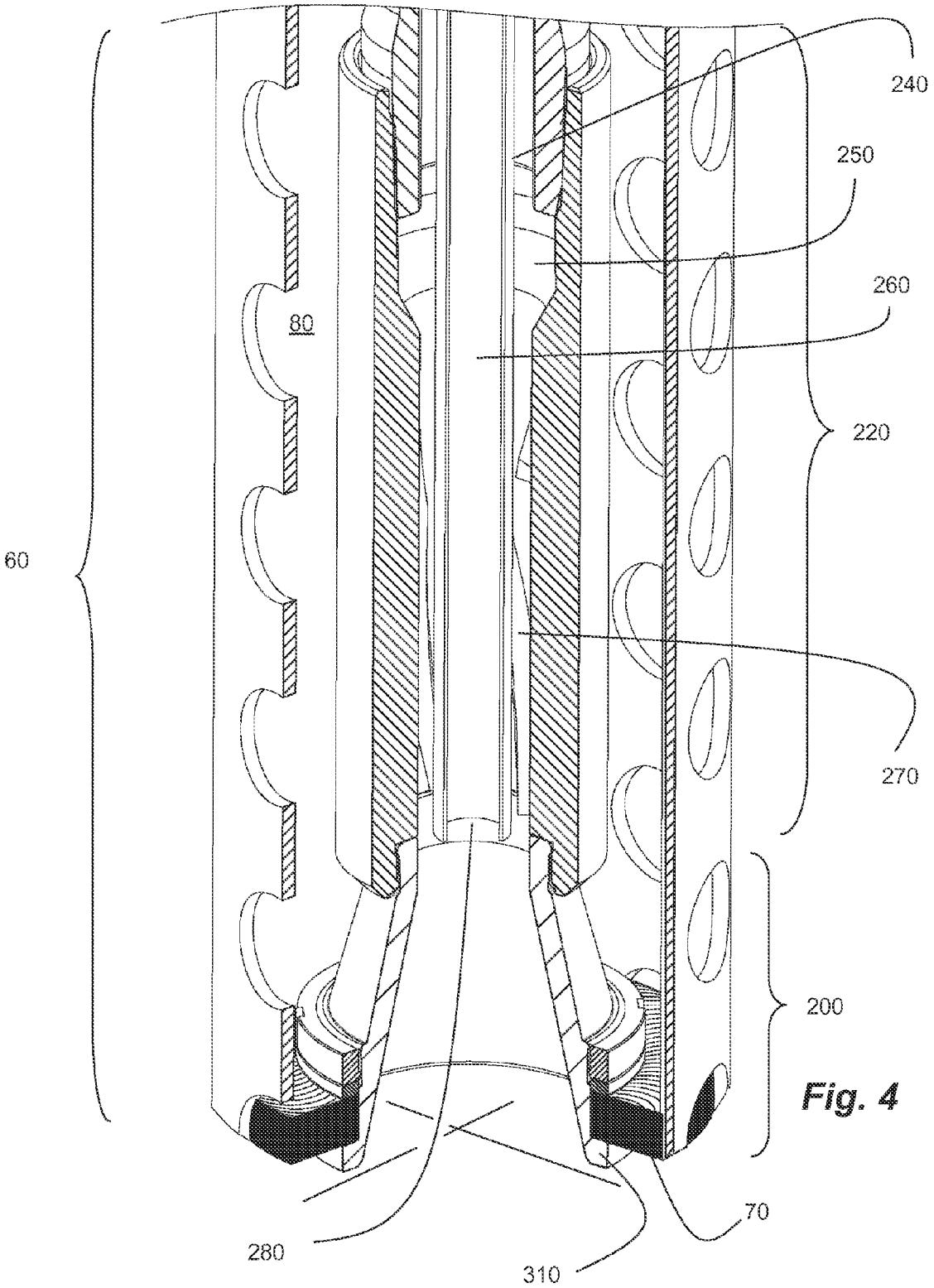
FIG. 4 is a side quarter-sectional view of an embodiment of a downhole burner sealed at a downhole end to a casing for fluidly connecting a casing annulus and the reservoir through perforations.

With further reference to FIGS. 1, 2B, 3, 4 and 13, apparatus for implementing such a process comprises a burner assembly 20 at a downhole end of a main tubing string 40 and one or more additional tubing strings. The main tubing string 40 and other tubing strings form a plurality of discrete fluid passageways for supplying the burner assembly 20. As shown in FIG. 4, the downhole burner 60 is terminated in an existing cased wellbore adjacent casing perforations accessing the reservoir 10. The burner assembly 20 can comprise a burner interface assembly 50 for fluidly connecting to the tubing strings, a downhole burner 60, and a casing seal 70 for sealing a casing annulus 80 between the downhole burner 60 and a casing 90 of the cased wellbore. The casing annulus 80 is yet another passageway used for directing water from the casing annulus 80 to the reservoir 10.

As shown in FIGS. 2A to 4, one approach is to suspend the burner assembly 20 from a conventional sectional tubing string supported by a conventional tubing hanger 100 on a wellhead 110. The casing annulus 80 is formed between the casing 90 of the wellbore and the main tubing string 40 and extends to the annular space between the casing 90 of the wellbore and the burner assembly 20.

An intermediate tubing string 120 having an intermediate bore, such as an intermediate coil tubing string, is supported by an intermediate tubing hanger 130 on the wellhead 110 and disposed within a bore of the main tubing string 40. An intermediate annulus 140 is formed between the main tubing string 40 and the intermediate tubing string 120.

An inner tubing string 150, such as an inner coil tubing string, is supported by an inner tubing hanger 160 on the wellhead 110 and is further disposed within the intermediate bore of the intermediate tubing string 120, forming a inner annulus 170 therebetween. The inner tubing string 150 further has an inner bore 180.

The wellhead 110 and tubing hangers 100, 130, 160 can be any appropriate wellhead and tubing hangers that are commonly available in the industry, such as the thermal wellhead and tubing hangers commercially available from StreamFlo Industries, Ltd., located at Edmonton, Alberta, Canada. The casing annulus 80, the intermediate annulus 140, inner annulus 170, and the inner bore 180 all define discrete passageways for supplying the burner assembly 20.

The casing 90 of the cased wellbore, main tubing string 40, the intermediate tubing string 120 and the inner tubing string 150, creating the four discrete passageways, terminate at the burner interface assembly 50. The casing annulus 80 terminates at the downhole burner 60 for communication with the reservoir 10. The inner annulus 170 terminates at the burner interface assembly 50. The two remaining discrete passageways, the intermediate annulus 140, and inner bore 180, all connect or terminate at the downhole burner 60.

In one embodiment, the downhole burner 60 implements at least two fluid passageways for conducting fuel and oxidant for combustion. The oxidant is a source of oxygen, conventionally air, or more concentrated source such as a purified stream of oxygen. In a preferred embodiment, purified oxygen is used as the oxidant instead of conventional air, as conventional air produces combustion gases having a substantial amount of gaseous nitrogen products.

The burner interface assembly 50 fluidly connects two of the discrete passageways to two fluid passageways of the downhole burner 60. In one arrangement, a third discrete passageway can be utilized as an isolating passageway between the fuel and the oxygen for sensing or detecting leaks in the discrete passageways for the fuel and oxygen.

The downhole burner 60 comprises a burner housing 190 having a downhole portion 200 for the mixing of fuel and oxygen. The burner housing 190 supports a high temperature casing seal 70 for sealing the casing annulus 80 from the combustion cavity 30. The sealed casing annulus 80 can be used to fluidly communicate water down to the target zone, which is then injected into the reservoir 10 for creating steam within the target zone, above the combustion cavity 30.

Figure 2A:
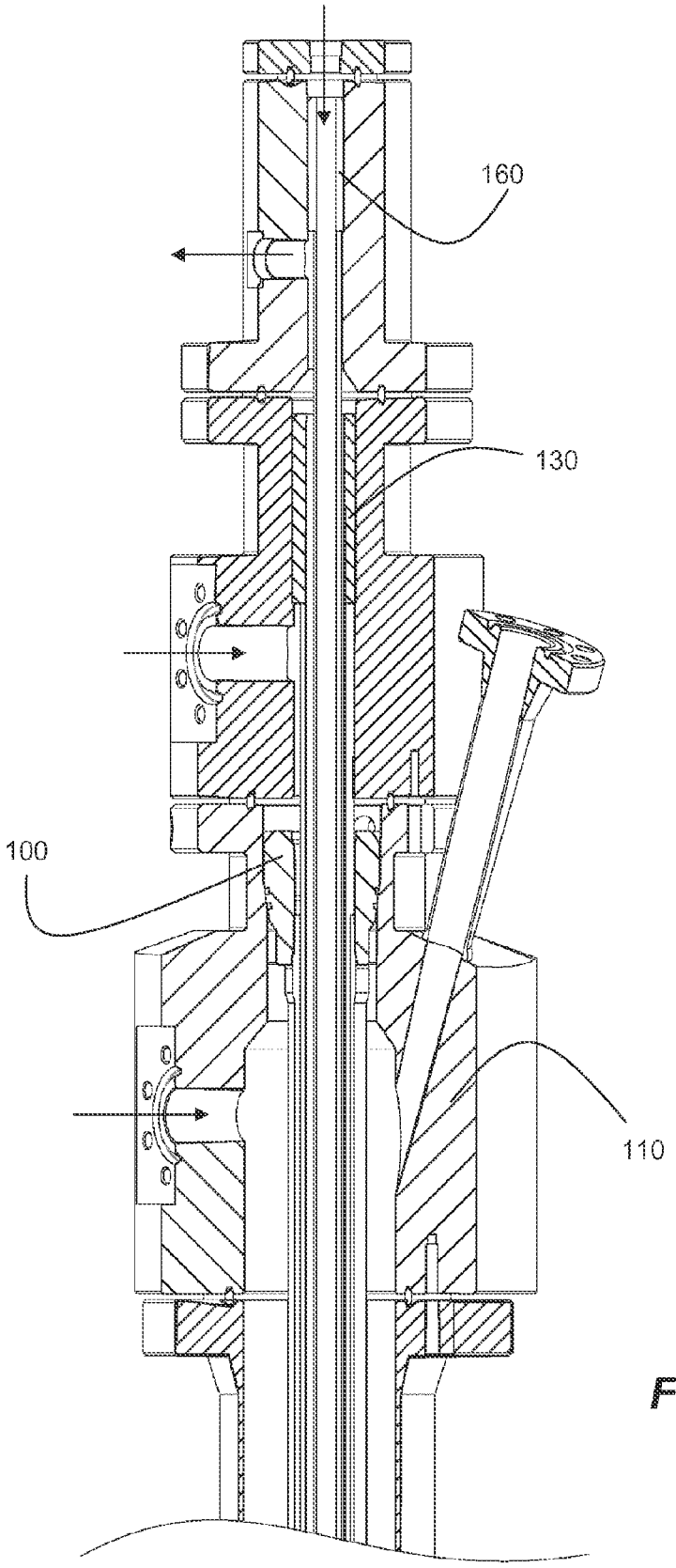
FIG. 2A is a side quarter-sectional view of a wellhead for supporting three tubing strings extending down a cased wellbore according to one embodiment of the present invention.

With reference to FIGS. 2A, 2B, and 3, one embodiment of the present invention comprises the burner assembly 20 fluidly connected to the main tubing string 40. A downhole burner 60 is positioned at a downhole portion of a cased portion of an injection well, the casing 90 being perforated into the reservoir 10. The main tubing string 40 extends downhole and has conduits or passageways for conducting or transporting each of fuel, and oxygen, to the downhole burner 60. For ease of installation, intermediate and inner tubing strings 120, 150 are releasably connected to the burner assembly 20.

The downhole components, or as part of the burner assembly 20, can further comprise a torque anchor 210 to set the main tubing string 40 in the casing 90.

In greater detail, and with reference to FIGS. 3 to 6, the burner housing 190 is adapted at an uphole portion 220 for fluid communication with the intermediate annulus 140 and inner bore 180. In one embodiment, the burner housing 190 is fluidly connected to the intermediate annulus 140 and the inner bore 180 through the burner interface assembly 50. The burner housing 190 comprises two fluid passageways for fluidly communicating the fuel and oxygen.

Figure 5:
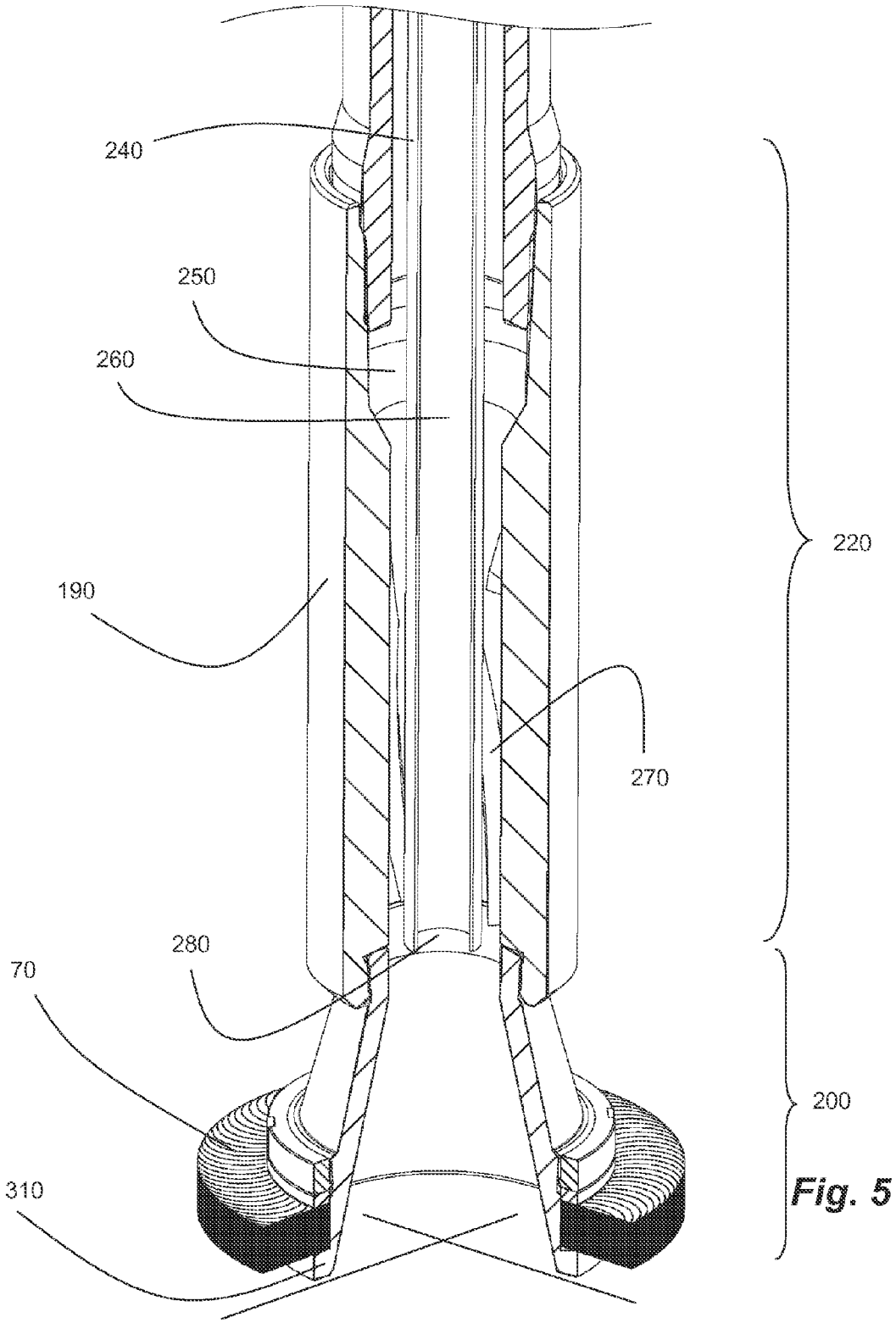
FIG. 5 is a side, quarter-sectional view of the burner of FIG. 3 with the casing omitted, and illustrating the fuel passageway, the oxygen passageway and the nozzle.
Figure 6:
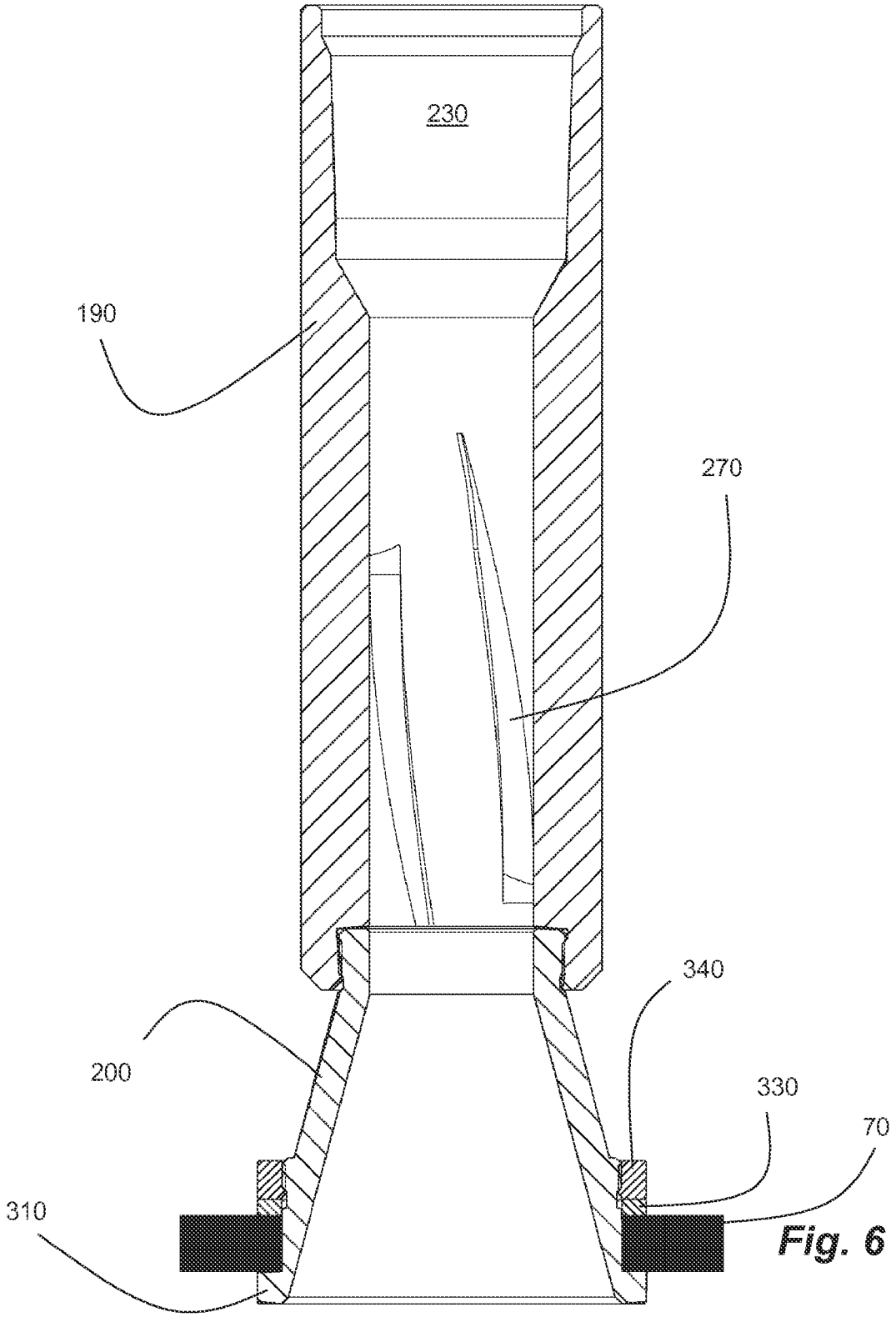
FIG. 6 is a side, quarter-sectional view of the burner of FIG. 3 with the casing and oxygen passageway omitted for illustrating the casing seal and an embodiment of fuel passageway swirl vanes.

As best shown in FIGS. 5 and 6, the burner housing 190 comprises the downhole portion or burner nozzle 200 for combustion of the fuel and oxygen and an uphole portion 220 defining the two fluid passageways for fluidly communicating the fuel and oxygen to the nozzle 200. The uphole portion 220 has a bore 230 and a concentric conduit or tubing 240 extending therethrough for creating the two fluid passageways. A fuel passageway 250 is defined by the annular space formed between the bore 230 and the concentric conduit 240. The concentric conduit 240 further has a bore defining an oxygen passageway 260.

The fuel passageway 250 is adapted to fluidly communicate with the intermediate annulus 140, communicating fuel from the surface to the nozzle 200. The bore 230 of the burner housing 190 and the fuel passageway 250 open into the nozzle 200 for injecting the fuel into the nozzle 200. The fuel passageway 250 can further have fuel swirl vanes 270 for aiding in the mixing of the fuel and oxygen.

The oxygen passageway 260 is in fluid communication with the inner bore 180, communicating oxygen from the surface to the nozzle 200. The oxygen passageway 260 has an opening 280 at a downhole end for injecting oxygen into the nozzle 200. The oxygen passageway 260 can further have oxygen swirl vanes (not shown) for aiding in the mixing of the fuel and oxygen. The oxygen and fuel mix for combustion at the nozzle 200.

With reference to FIG. 5, as stated above, the fuel passageway 250 can further have fuel swirl vanes 270 for imparting a rotation to the fuel being injected into the nozzle 200. The oxygen passageway 260 can also have oxygen swirl vanes for imparting a rotation, counter to the direction of the rotation of the fuel, for maximizing the mixing of the fuel and oxygen for increasing the efficiency of the combustion of the fuel and oxygen. In a preferred embodiment, the ratio of swirl velocity to axial flow velocity of either the fuel or oxygen is substantially 1:2.

In an alternate embodiment, the opening 280 of the oxygen passageway 260 can be fitted with a bluff body (not shown) to reduce the axial momentum of the oxygen for stabilizing the combustion flame.

Further, in another alternate embodiment (not shown), the burner housing 190 can have two side-by-side bores extending therethrough for forming the fuel passageway and the oxygen passageway. Each bore can have an opening at a downhole end for injecting the fuel and oxygen into the nozzle 200 for combustion.

Conventional burner discharge arrangements can be employed including utilizing a plurality of orifices and concentric discharges. The nozzle 200 can be any open ended tubular structure that allows mixing and combustion of the fuel and oxygen. As shown, the nozzle 200 is a typical inverted truncated frusto-conical nozzle. The truncated apex is fluidly connected to the burner housing 190 and the nozzle 200 extends radially outwardly towards a downhole end.

As shown in FIGS. 4 and 6, the high temperature casing seal 70 can be located on the downhole burner 60 to isolate the casing annulus 80 from the combustion cavity 30. Accordingly, the casing seal 70 is generally located low on the downhole burner 60, such as between the downhole portion of the burner housing or nozzle 200 and the casing 90. In alternate embodiments (not shown), the casing seal 70 can located between the uphole portion 220 of the burner housing 190 and the casing 90.

Often, cased wellbores have casing distortions or kinks which introduce challenges to installation and tolerances for related seals to the casing. The casing distortions are an abrupt shifting of the casing axis resulting in a casing portion that is narrower than a nominal inner diameter of a typical casing. The passage of seals and other downhole tools are difficult at best if the nature of the seal is to initially comprise an outer diameter of seal which is larger than the inner diameter of casing and certainly greater than the distortion. Although downhole tools generally can be manufactured to have a small outer diameter to allow them to pass through a majority of distortions, seals generally can not. Seals having small outer diameter, although capable of passing through the distortions, are unlikely to fully seal against the casing downhole of the distortion where the casing again has a nominal inner diameter. Seals must also be able to withstand the extreme heat conditions created by a downhole burner when combusting the fuel and oxygen.

With reference to FIGS. 6 to 9, an embodiment of the casing seal 70 is a brush-type seal comprising a plurality of flexible, concentric, metallic brush rings 300 stacked one on top of another. As best shown in FIGS. 6, 7A and 7B, the brush rings 300 are stacked one on top of another upon a circumferential stop shoulder 310 at a downhole end of the nozzle 200. Spacer rings 320 can be provided to alternate between the brush rings 300. The stack of brush rings 300 and spacer rings 320 is secured in place by a compression ring 330 exerting an axial securing force to sandwich the rings 300, 320 to the stop shoulder 310. A compression nut 340 secures the compression ring 330.

Figure 8:
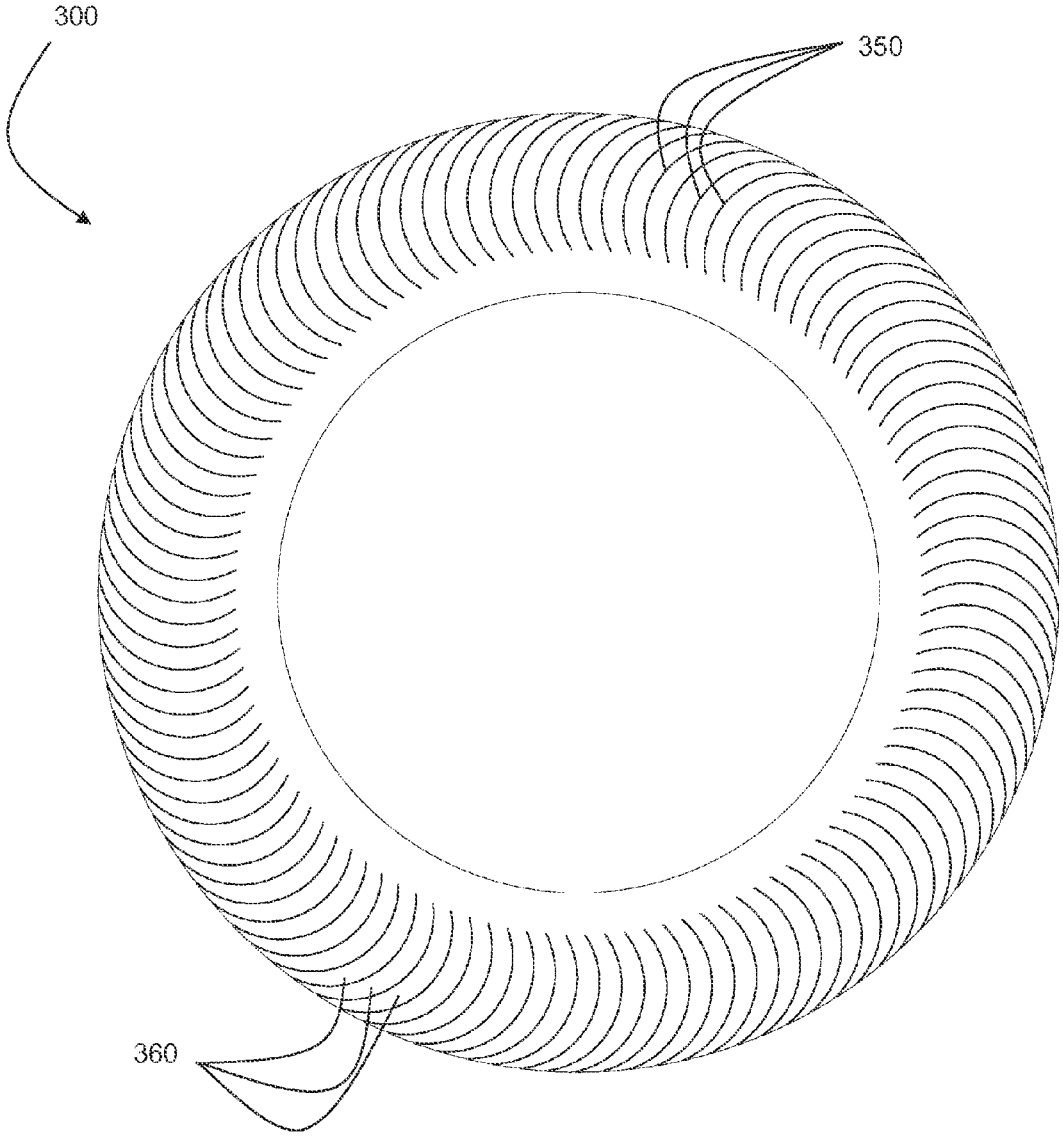
FIG. 8 is a overhead plan view of one concentric brush ring of a stack of concentric brush rings of a brush seal and an arrangement of spiral slits and fingers.
Figure 9:
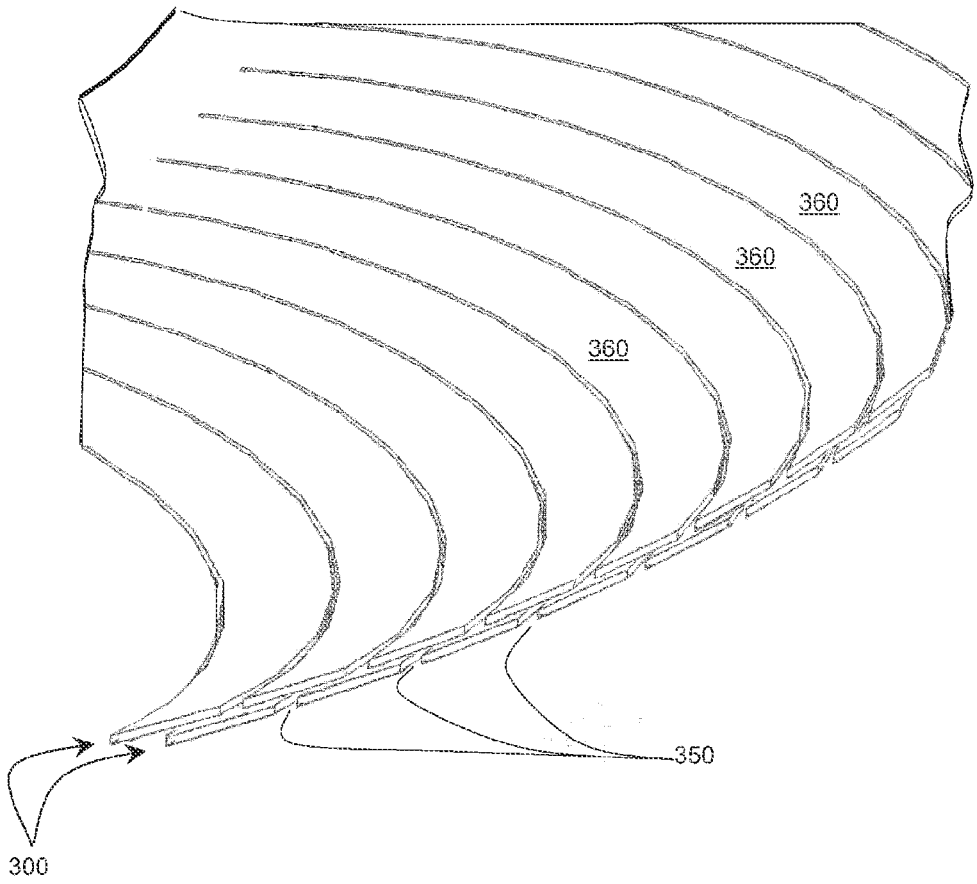
FIG. 9 is a perspective view of two brush rings of the stack of concentric brush rings according to FIG. 8 illustrating a rotational offsetting of the spiral slits for forming a tortuous, restrictive fluid path therethrough.

As shown in FIGS. 8 and 9, each seal ring 300 has a multiplicity of slits 350 that are formed radially inward from an outer circumference of the seal ring 300 and which terminate before an inner diameter of the seal ring 300 for forming a plurality of flexible fingers 360. The fingers are separated at the outer circumference and connected at the inner diameter. An inner most radial extension of each slit 350 defines the inner diameter of the multiplicity of slits 350 and is substantially the same as the outer diameter of the spacer rings 320. The plurality of fingers 360, flexing from the inner diameter, provide dimensional variability through flexibility for each concentric seal ring 300.

Each slit 350 extends radially outwardly in a generally clockwise direction as viewed looking downhole. This particular slit arrangement or design is advantageous when removing and pulling up the casing seal 70. In the event that the casing seal 70 becomes stuck, the clockwise slit arrangement allows the casing seal to be rotated in a counter-clockwise direction, thus decreasing the outer diameter of the casing seal 70, and allowing it to dislodge from the casing 90.

As shown in FIG. 9, each seal ring 300 can be rotationally indexed relative to each adjacent seal ring 300. While enabling radial flexibility, the slits 350 provide an avenue for fluids to leak therethrough. In order to minimize the amount of leaking of fluids through the slits 350, each seal ring 300 is rotated such that the slits 350 of axially adjacent brush rings 300 are rotationally offset or misaligned. To further mitigate leakage through the slits 350, the plurality of concentric brush rings 300 are stacked. Each finger 360 of one seal ring 300 overlaps each finger 360 of an adjacent seal ring 300, for forming a tortuous axial path for restricting flow of casing annulus fluids therethrough.

Referring back to FIG. 7A, the brush seal 70 has an outer diameter greater than a nominal inner diameter of a casing 90 in a cased wellbore as indicated by the dashed line. The greater outer diameter defines the effective sealing diameter of a particular brush seal. Brush-type seals having differing effective sealing diameters can be readily installed depending on the size of the casing 90 in the cased wellbore.

When the brush-type seal is run downhole, each finger 360 of each seal ring 300 flexes uphole, reducing the overall outer diameter and conforming to the casing 90, while maintaining the effective sealing diameter. The reduction of the overall outer diameter of the brush rings 300 allow the brush seal 70 to pass through a cased wellbore during installation and pass by most casing distortions. Upon encountering a casing distortion, the ring fingers 360 of each concentric seal ring 300 can elastically flex an additional amount to enable movement past the distortion.

In an alternate embodiment, other casing seals might be employed including a metallic inflatable packer, such as those now introduced by Baker Oil Tools, as presented in a paper entitled "Recent Metal-to-Metal Sealing Technology for Zonal Isolation Applications Demonstrates Potential for Use in Hostile HP/HT Environments", published as SPE 105854 in February 2007. Such inflatable packers are small enough in diameter to also pass through casing distortions and may be able to withstand the extreme heat conditions created by the burner. However, such packers can be damaged by thermal cycling and may not be reusable.

For example, in a 7 inch (178 mm) casing having an inner diameter of about 164 mm, a burner bottom hole assembly (BHA) fluidly connected to the downhole end of a 3½ inch (89 mm) tubing, can be placed in a cased wellbore having the typical casing distortions. The burner BHA, comprising the burner interface assembly, pup joint, and downhole burner, had a total length of about 5 feet (1524 mm). A 2⅜ inch (60 mm) intermediate coil tubing was disposed within the 3½ inch (89 mm) tubing, and a 1¼ inch (32 mm) inner coil tubing was disposed within the intermediate coil tubing. The burner interface assembly was about 708 mm long and had an outer diameter of about 114 mm, while the burner housing was about 304 mm long with an outer diameter of about 93 mm. The brush seal had an outer diameter of about 164 mm and was installed on a nozzle having a circumferential shoulder of about 120 mm. Each brush ring and spacer ring had a thickness of about 0.25 mm. The pup joint, tailored to this particular example, was about 508 mm long and had an outer diameter of about 2⅞ inches (73 mm).

Figure 10:
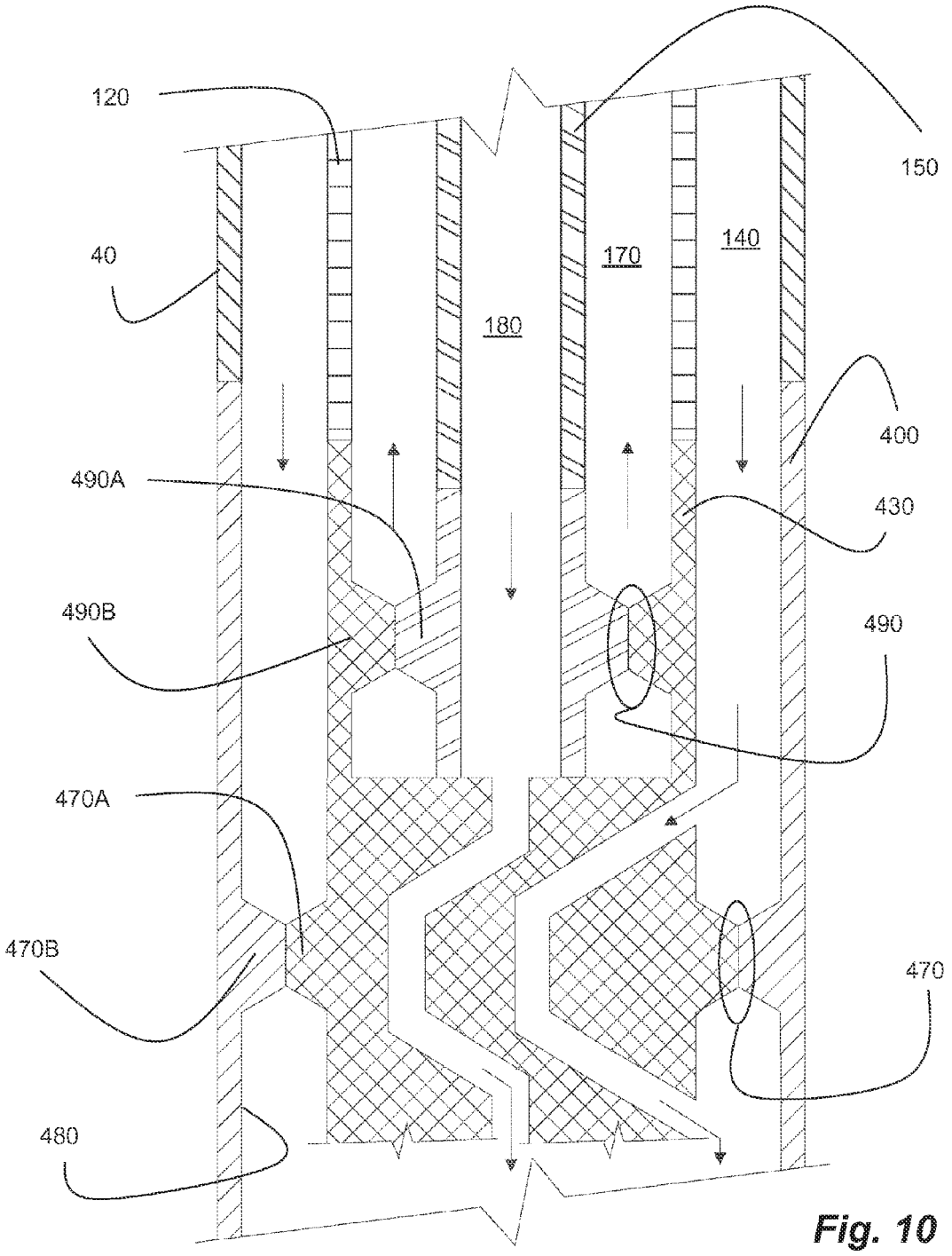
FIG. 10 is a schematic representation a main tubing string, an intermediate tubing latched within the bore of the main tubing string, and an inner tubing latched and terminated within the bore of the intermediate tubing, three fluid passageways created therein, the inner annulus being terminated at the intermediate mandrel.

With reference to FIGS. 3 and 10, the fluid passageways can be formed by a series of tubing strings disposed in the bore of a larger tubing, or sectional tubing. Alternatively, two or more tubing strings might be arranged side-by-side (not shown). As shown in FIG. 3, the main tubing 40 is run down the cased wellbore forming the casing annulus 80 or a first casing annular fluid passageway therebetween. The intermediate tubing string 120 is disposed concentrically within the bore of the main tubing string 40, forming the intermediate annulus 140 or a second intermediate annular fluid passageway therebetween. The inner tubing string 150 is further disposed concentrically within the intermediate bore of the intermediate tubing string 120 forming the inner annulus 170 or a third inner annular fluid passageway therebetween. The bore of the inner tubing string 150 further defines the inner bore 180 or a fourth, inner bore fluid passageway.

Those skilled in the art would understand that although the intermediate tubing string 120 is concentrically disposed with the bore of the main tubing 40, the intermediate tubing string 120 may not remain concentrically aligned within the bore of the main tubing 40 as the intermediate tubing string 120 is run downhole. Similarly, the inner tubing string 150, although concentrically disposed in the intermediate bore of the intermediate tubing string 120 may not remain concentrically aligned as the inner tubing string 150 is run downhole.

In a basic form, two passageways are used for providing fuel and oxygen to the burner. A third passageway can be provided for isolating the fuel and oxygen, and even more favourably for acting as a sensing passageway for determining development of a leak therebetween.

Figure 11:
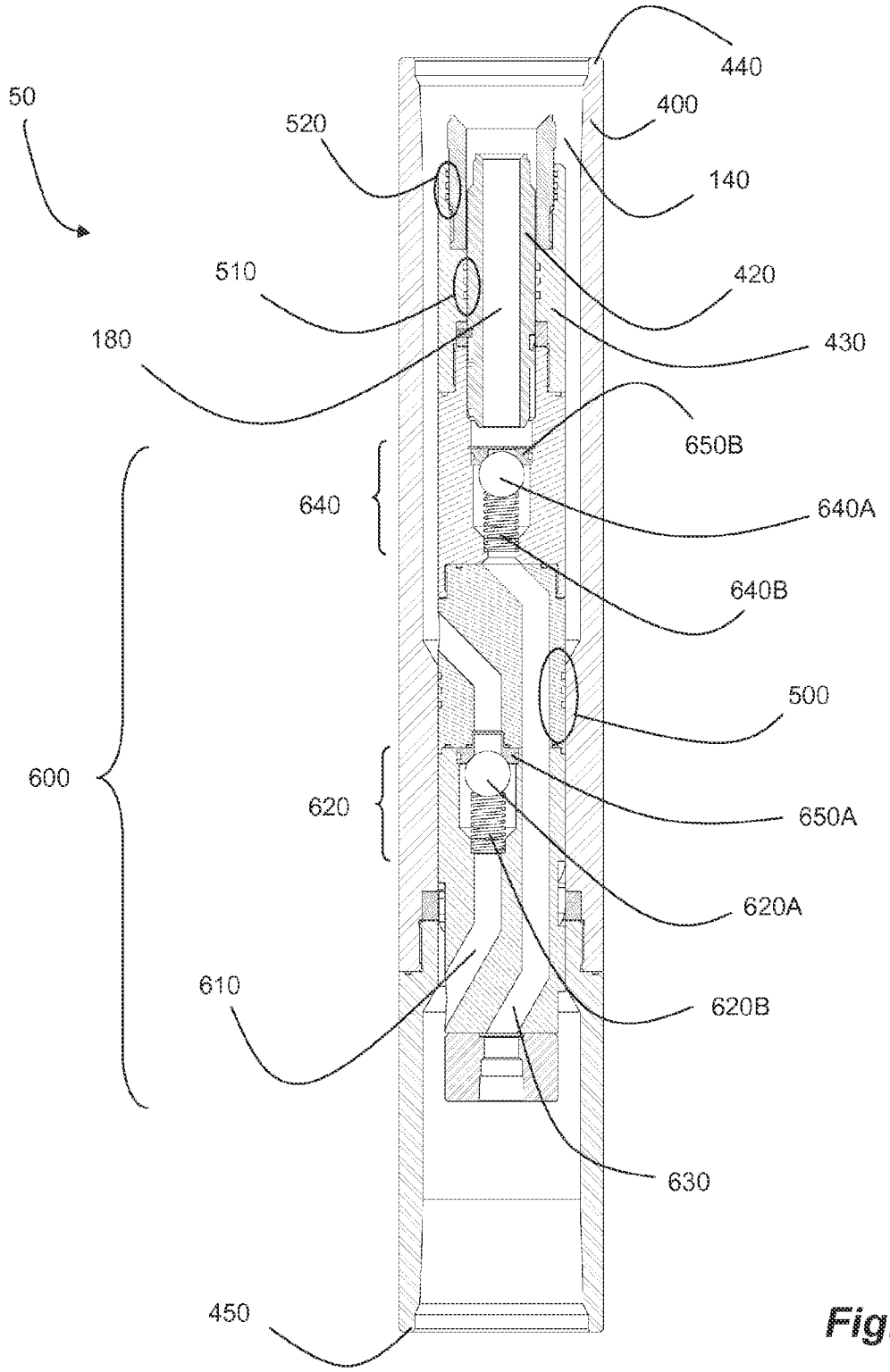
FIG. 11 is a cross-sectional view of the burner interface assembly illustrating the outer housing, the intermediate and inner mandrels, the intermediate and inner latch assemblies, and the backpressure valve assembly.
Figure 12:
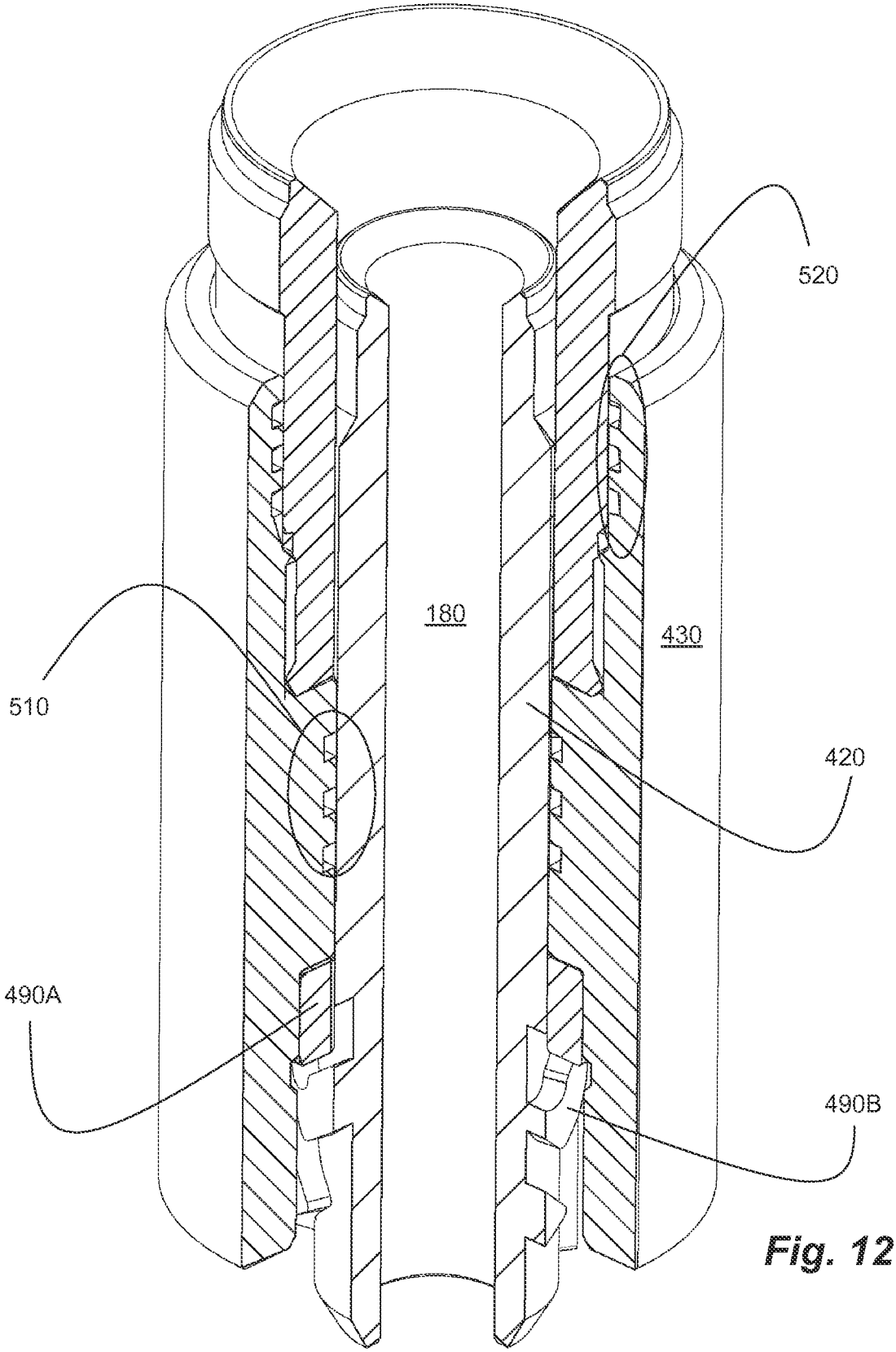
FIG. 12 is a side quarter-sectional view of an uphole end of the intermediate mandrel for illustrating termination of the inner and intermediate tubing and the inner mandrel having an inner tubing latch.

With reference to FIGS. 10 to 12, in one embodiment, a burner interface assembly 50 fluidly connects three passageways of the main tubing 40 to the fuel and oxygen passageways 250, 260 of the downhole burner 60. The burner interface assembly 50 can comprise an outer housing 400 secured intermediate or at the downhole end of the main tubing string 40, an intermediate mandrel 410 at a downhole end of the intermediate tubing string 120, and an inner mandrel 420 at a downhole end of the inner tubing string 150.

The outer housing 400 has a bore which is adapted to releaseably connect with the intermediate mandrel 410. The intermediate mandrel 410 has an uphole portion 430 having a bore which is adapted to releaseably connect with the inner mandrel 420.

In greater detail, and with reference to FIG. 11, the outer housing 400 has a bore, an uphole end 440 and a downhole end 450. The uphole end 440 is adapted to fluidly connect to the main tubing string (not shown) and the downhole end 450 is adapted to fluidly connect to a pup joint which supports the downhole burner (not shown).

With reference to FIGS. 10 and 11, the intermediate mandrel 410 is fit within the bore of the outer housing 400 forming the intermediate annulus 140 therebetween. The intermediate mandrel 410, releaseably connected to the outer housing 400 at an intermediate latch assembly 470, has an uphole portion 430 which is adapted to fluidly connect to the intermediate tubing string 120. The uphole portion 430 further has a bore for releaseably connecting to the inner mandrel 420. In one embodiment, the uphole portion 430 is an inner latch housing.

The bore of the outer housing 400 has an inner surface 480 for forming a first intermediate latch 470A. The first intermediate latch 470A is formed adjacent a downhole end of the outer housing 400.

Further, the intermediate mandrel 410 has a second intermediate latch 470B formed at its downhole end. The second intermediate latch 470B is adapted to releaseably connect to the complementary first intermediate latch 470A to form the intermediate latch assembly 470.

With reference to FIGS. 10 and 12, the inner mandrel 420 is fit within the bore of the inner latch housing 430 and releasably connects with the intermediate mandrel 410 at an inner latch assembly 490. Similar to the intermediate latch assembly 470, the inner latch assembly 490 comprises a first inner latch 490A and a complementary second inner latch 490B.

As shown, the intermediate mandrel 410 is fit within the bore of the outer housing 400 for latching at the intermediate latch assembly 470 and sealing at a first seal 500 therebetween. The inner mandrel 420 is fit within the bore of the inner latch housing 430 for latching at the inner latch assembly 490 and sealing at a second seal 510 therebetween.

The intermediate annulus 140 is contiguous with an annular space between the outer housing 400 and the intermediate mandrel 410 and is in fluid communication with the fuel passageway 250 of the downhole burner 60. The inner bore 180 is contiguous with a bore of the inner mandrel 420 and is in fluid communication with the oxygen passageway 260 of the downhole burner 60. In this embodiment, the inner annulus 170 happens to terminate sealably at the second seal 510 for isolating the intermediate annulus 140 from the inner bore 180.

The sealed inner annulus 170 isolates the intermediate annulus 140 from the inner bore 180. This separation of the two discrete passageways provides a safety measure, ensuring that the fuel and the oxygen are separated by a buffer. In one embodiment, the sealed inner annulus 170 is also a sensing annulus for detecting leakage in the transport of the fuel and the oxygen. The sealed inner annulus 170 can be maintained in a vacuum or other pressure and is monitored for determining change in pressure indicative of a leak in either the intermediate annulus 140 or the inner bore 180.

The intermediate latch assembly 470 can be any suitable releasable latch used in the industry, but in a preferred embodiment, the intermediate latch assembly is a type of latch assembly disclosed and claimed in US Pat. Serial No. 6,978,830, issued on Dec. 27, 2005, to MSI Machineering Solutions, Inc., located in Providenciales, Turks and Caicos.

Similar to the intermediate latch assembly 470, the inner latch assembly 490 can be any suitable latch assembly used in the industry, including that disclosed and claimed in the aforementioned U.S. Pat. No. 6,978,830.

As best shown in FIG. 12, an uphole end of the inner latch housing 430 is fit with a third seal 520 for sealing and isolating the intermediate annulus 140 from the inner annulus 170. The inner latch housing 430 further has a second seal 510 for sealing and isolating the inner annulus 170 from the inner bore 180.

For redundancy purposes, and to ensure sealing and isolating of the three discrete passageways, the first, second, and third seals 500, 510, 520 can be a plurality of individual seals in a stacked arrangement.

For greater safety and control of the fuel and oxygen passageways, and in a particular embodiment, the intermediate mandrel 410 can further comprise a backpressure valve assembly 600 for controlling the flow of the fuel and oxygen. Fuel is forced from the intermediate annulus 140 through the backpressure valve assembly by the first seal 500.

The backpressure valve assembly 600 comprises two fluid bypass passageways, each having a backpressure valve. The fluid bypass passageways bypass the first seal 500. A first bypass passageway 610, having a first backpressure valve 620, is in fluid communication with the intermediate annulus 140 for transporting the fuel from the main tubing string 40 to the fuel passageway 250 of the downhole burner 60. A second bypass passageway 630, having a second backpressure valve 640, is in fluid communication with the inner bore 180 for transporting the oxygen to the oxygen passageway 260 of the downhole burner 60.

Each of the backpressure valves comprises a ball 620A, 640A and a spring 620B, 640B, biased to apply a constant closing force on the ball, ensuring that the ball is sealingly fit within a ball seat 650A, 650B. The constant closing force is greater than the force applied by the differential fluid pressure between the static fluid pressure above the backpressure valves 620, 640 and a reservoir pressure below the backpressure valves 620, 640. For either the fuel and/or oxygen to flow pass the backpressure valves 620, 640, the injection pressure of the fuel or oxygen must exert enough force to overcome the combined forces of the spring 620B, 640B and the reservoir pressure.

In one embodiment, the closing force biasing the ball of the backpressure valves 620, 640 is based upon a differential pressure of 200 psi. In this embodiment, the injection pressure of both the fuel and oxygen must be sufficient to exert sufficient pressure to overcome the combined forces of the closing force and the force exerted by the reservoir pressure.

The injection pressure of the fuel or oxygen does not exceed the fracturing pressure of the particular target zone.

In Operation

In a broad aspect, hot combustion gases can be introduced into a target zone of a hydrocarbon reservoir and allowed to permeate therethrough. In one embodiment, introduction of the hot combustion gases can be accomplished by arranging a burner assembly, such as a downhole burner, for access to a cavity in a target zone of the hydrocarbon reservoir. Hot combustion gases from the burner assembly are permitted to permeate from the cavity and through the target zone.

Subsequently, water is also injected into the target zone and is also allowed to permeate through the target zone for interacting with the heated target zone and hot combustion gases therein. The interaction of the water with the hot combustion gases creates steam within the target zone for creating a drive front in the hydrocarbon reservoir. While some steam is likely to form in the cavity, primarily steam forms in the reservoir, spaced from the cavity itself, at a hot gas / water interface.

Applicant notes that the cavity can be any pre-existing cavity, naturally occurring or otherwise artificially created using downhole tools. A cavity, whether pre-existing or created can be worked on by a variety or combination of techniques. Cavity size and shape can be manipulated to extend or otherwise accommodate a combustion zone of the particular burner assembly and to form a cavity-to-hydrocarbon reservoir interface. The cavity reservoir interface, at a cavity envelope, forms an interface surface area between the hot combustion gases from the burner assembly and the target zone, and the larger the interface area, the better the access of the hot gases to the reservoir, particularly when the reservoir is characterized by a low permeability.

Simply, one accesses the cavity with a wellbore, whether the wellbore is pre-existing yet lacking a cavity, or the cavity is pre-existing and initially lacking a wellbore. Where wellbore exists or is formed, one runs the burner assembly down the wellbore to access the target zone. If the cavity does not exit, one is created. If the cavity was formed by means other than running in and operating the burner assembly, the burner assembly run downhole and arranged to access the cavity.

Figure 16A:
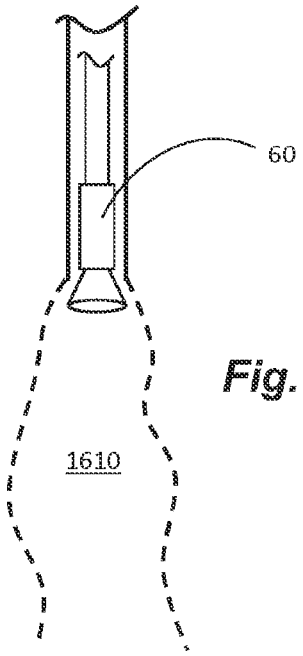
FIG. 16A is a schematic representation of an embodiment of a burner assembly accessing a cavity created artificially by reaming.

As shown in FIG. 16A a cavity 1610 can be artificially created by reaming or hydraulic washing operations. Reaming of formations accessed by a wellbore is a known technique and includes tools and methods of bi-directional underreaming and backreaming. Hydraulic washing tools, including jetting, are also known for casing and formations. One accesses the target zone with a wellbore and runs in a tool downhole of the wellbore. In the case of a reaming tool, actuating the reaming tool such as by expanding the tool and reaming the target zone to form the cavity. In the case of a hydraulic washing tool, one actuates the washing tool for hydraulic washing of the target zone to form the cavity. The burner 60 is run in to access the cavity 1610.

Any radial limitations of reaming might be further supplemented with additional hydraulic washing operations using appropriate combination reaming and hydraulic tools or staged independent tools.

Figure 16B:
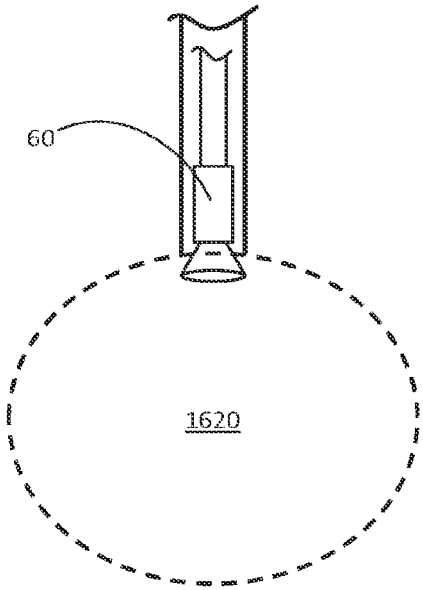
FIG. 16B is a schematic representation of an embodiment of a burner assembly accessing a cavity created artificially by hydraulic washing.

As shown in FIG. 16B, a cavity 1620 can be created artificially by combustion. One accesses the target zone with the wellbore. The burner assembly 60 is run in to the target zone. The burner assembly 60 is operated at a first condition for directing combustion into wellbore to form the cavity 1620. The first condition may be at higher overall heat output or at higher temperatures so as to melt or otherwise degrade the target zone about the discharge of the burner assembly. Thereafter, the burner assembly 60 is operated at a second condition for directing combustion into the created cavity to form the hot combustion gases.

Figure 16C:
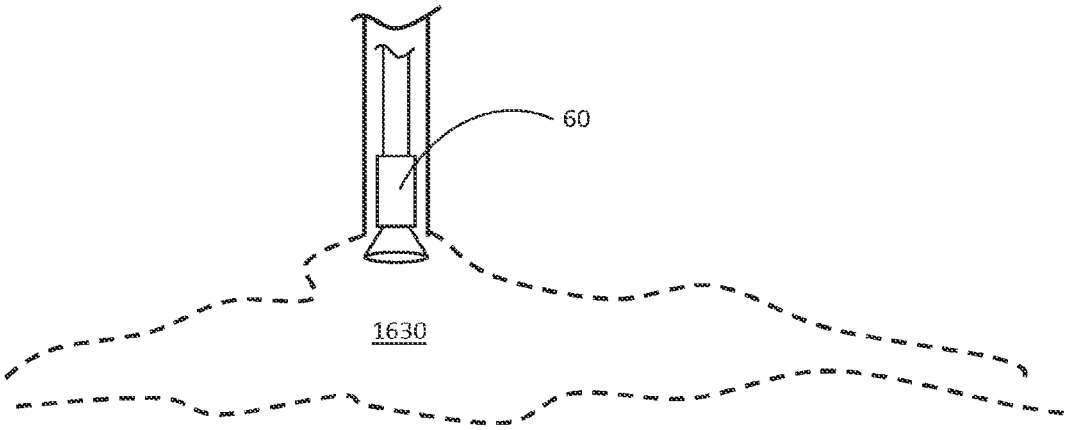
FIG. 16C is schematic representation representative drawing of an embodiment of a burner assembly accessing a pre-existing cavity.

FIG. 16C illustrates a pre-existing or naturally occurring cavity 1630, such as geological cavities and cavities formed as a result prior operations in the hydrocarbon reservoir. One example of a cavity created by prior operations includes a sand-depleted cavity in a Cold Heavy Oil Production with Sand (CHOPS) reservoir. Applicants understand that in some cases of CHOPS production from the wellbore, a cavity 1630 can be formed about the producing well. Thus, before the burner assembly 60 is run downhole, there is a pre-existing cavity in the target zone about the wellbore.

Water is injected into the target zone by injecting water from a wellbore annulus 80. In one embodiment, injection of water W can be accomplished by injecting water W through an annulus 60 about the burner assembly 60 for entering into the target zone. In an embodiment illustrated previously in FIG. 4, the burner assembly 60 can have an annular seal 70 for sealing the annulus 80 and permitting injection of the water W into the target zone uphole of the annular seal. Accordingly, one seals the wellbore annulus 80 with an annular seal 70 at about the burner assembly 60 and water is injected into the target zone uphole of the annular seal 70.

Figure 17:
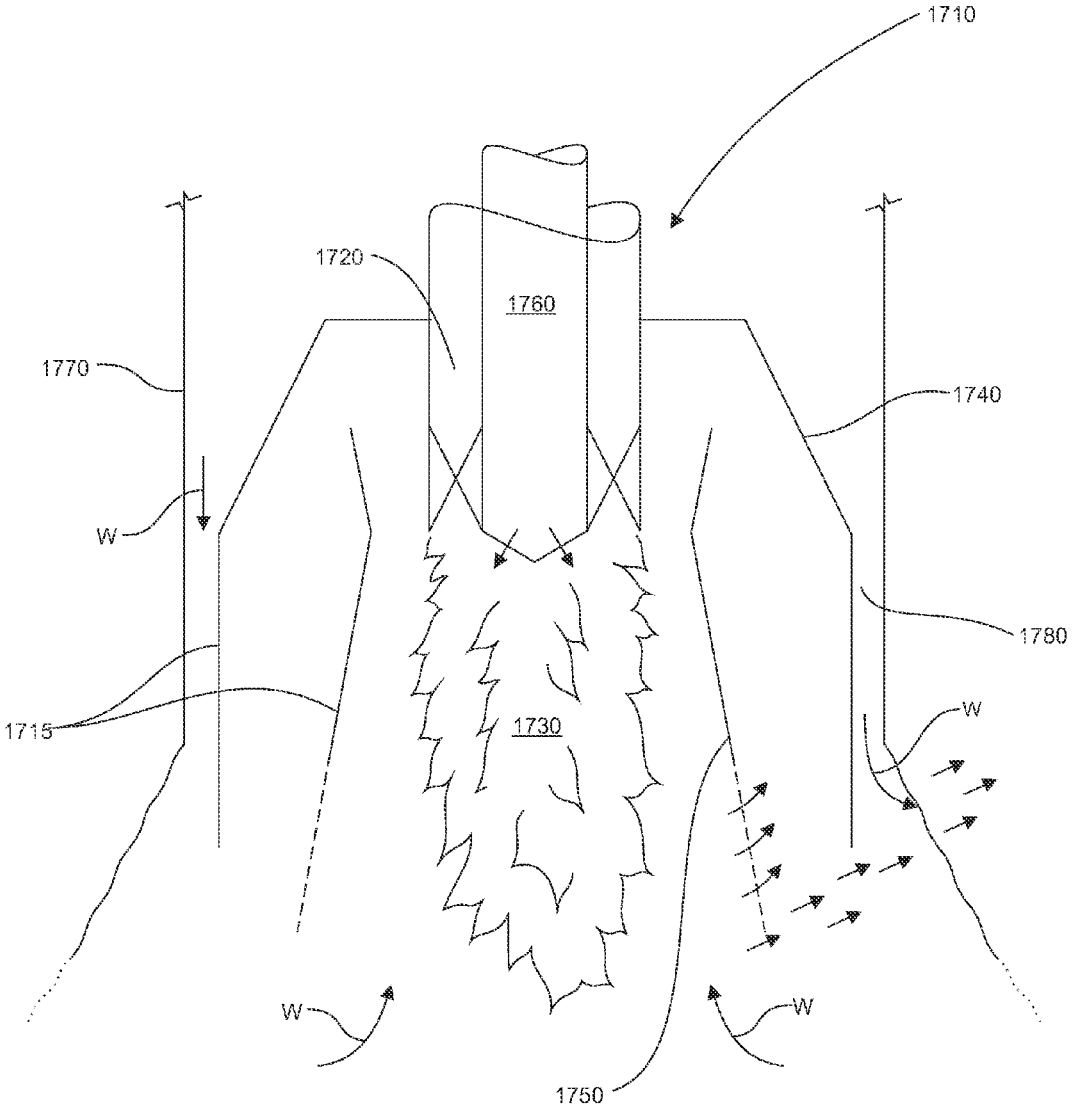
FIG. 17 is a schematic representation of a burner assembly fit with a shroud disposed at a downhole end thereof and receiving injected water thereabout.

With reference to FIG. 17, in another embodiment, and as described in Applicant's U.S. 61/560,468 and incorporated fully herein by reference, a burner assembly 1710 can have a shroud 1715 disposed at a downhole end 1720 surrounding a combustion zone 1730 thereof. As shown, the shroud 1715 can comprise an outer shroud 1740 and an inner shroud 1750 surrounding the combustion zone 1730 of the burner assembly 1710. Water W from an outer annulus 1780 is injected into the target zone from about the shroud 1715.

As shown, the burner assembly 1710 is illustrated depending from fuel and oxygen lines 1760 running downhole in a cased wellbore 1770. In the context shown, the burner assembly 1710 is positioned for discharge of hot flue gases uphole of a cavity (not shown) of a target zone within a hydrocarbon-bearing formation. The shroud 1715 is fit about the combustion zone 1730 of the burner assembly 1710.

The outer shroud 1740 is exposed to the target zone. An outer annulus 1780 is formed between the target zone and the outer shroud 1740. Water injected above the burner assembly 1710 or in the annulus 1780 between the oxy/fuel conduit 1760 can flow into the target zone, along the outer annulus 1780, and to a base of the outer shroud 1740.

Injection of water W through the annulus 1780 comprises injection of water E into the target zone from about the outer shroud 1740.

In greater detail for one embodiment, a combustion chamber 30 is formed by melting a target zone at a temperature sufficient enough to melt the hydrocarbon reservoir 10 at the target zone. Thereafter, a steady state combustion is maintained for sustaining a sub-stoichiometric combustion of the fuel and oxygen for producing hot combustion gases (primarily CO, $CO_2$, and $H_2O$) which enter and permeate through the reservoir 10. The hot combustion gases create a gaseous drive front and heat the reservoir 10 adjacent the combustion cavity 30 and the wellbore.

Addition of water to the reservoir 10 along the casing annulus 80 above the combustion chamber 30 injects water into an upper portion of the reservoir 10 adjacent the wellbore for lateral permeation through the reservoir 10. The lateral movement of the injected water cools the wellbore from the heat of the hot combustion gases and minimizes heat loss to the formation adjacent the wellbore. The water further laterally permeates through the reservoir 10 and converts into steam. The steam and the hot combustion gases in the reservoir 10 form a steam and gaseous drive front.

In more detail and referring again to FIGS. 1, and 13-15B, an injection well is cased and perforated at a target zone of the reservoir 10.

A packer is set and a suitable depth of thermal cement is placed below the target zone. The thermal cement protects the packer from the downhole burner 60.

Figure 13:
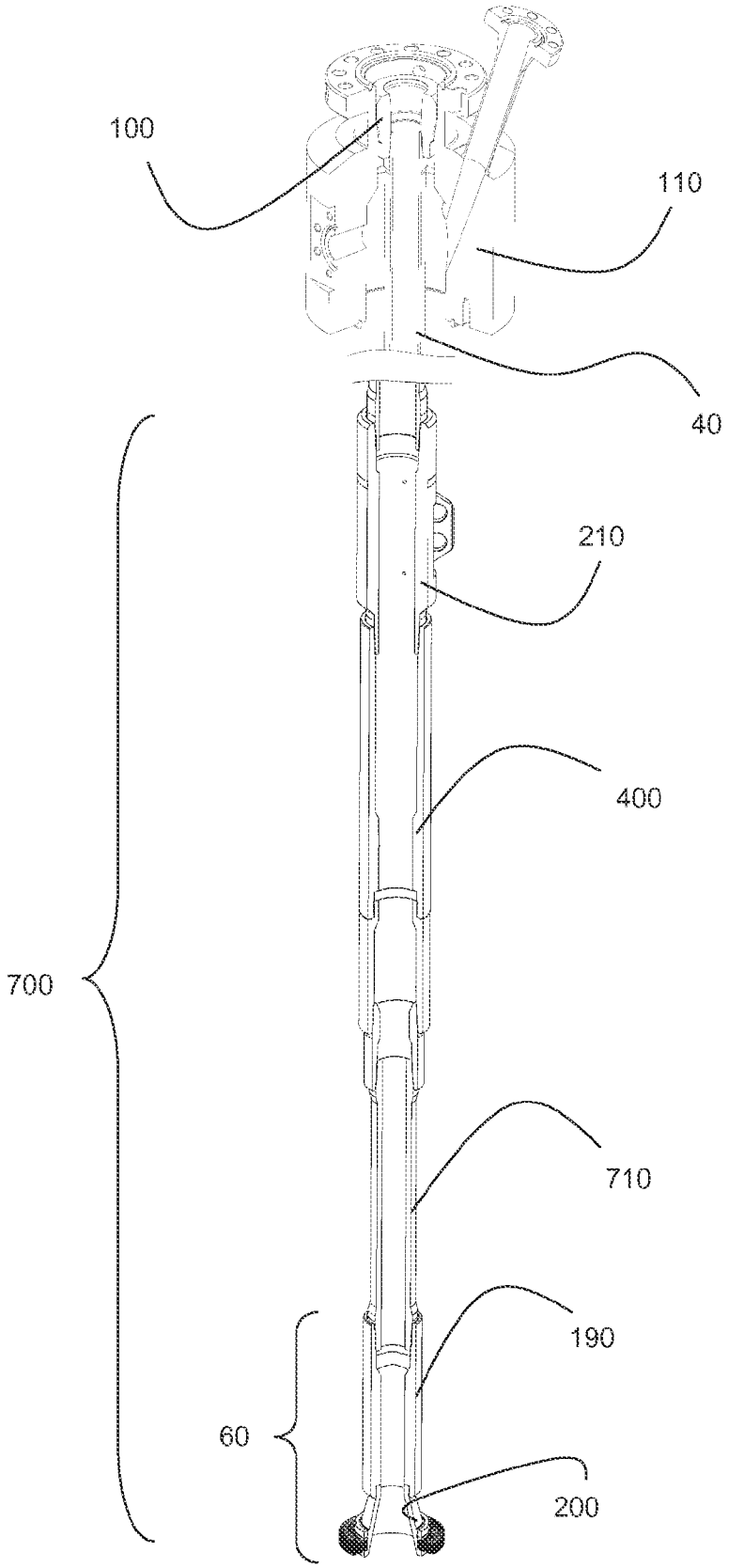
FIG. 13 is a quarter-sectional and elevation view of a step of the running in of an embodiment of the apparatus of the invention, more particularly illustrating the main tubing hanger, and downhole adjacent the reservoir, a torque anchor, outer housing, pup joint, burner housing, burner nozzle and casing seal.

Referring to FIG. 13, a first main tubing hanger 100 is affixed to a wellhead 110. A burner bottom hole assembly (burner BHA) 700 comprising a torque anchor 210, the outer housing 400 of the burner interface assembly 50, a pup joint 710, and the downhole burner 60 are fluidly connected to a downhole end of a main tubing string 40. The burner BHA 700 is run downhole to a depth for positioning the downhole burner 60 within a target zone. In one embodiment, the downhole burner 60 is positioned at about the midpoint of the target zone. Once in position, the main tubing string 40 is rotated to set the torque anchor 210 and the main tubing string 40 is hung from the main tubing hanger 100.

As shown in FIGS. 1 and 3, the main tubing string 40 and the casing 90 of the wellbore form a casing annulus 80 therebetween. The casing seal 70 between the burner housing 190 and the casing 90 seals the casing annulus 80.

Figure 14A:
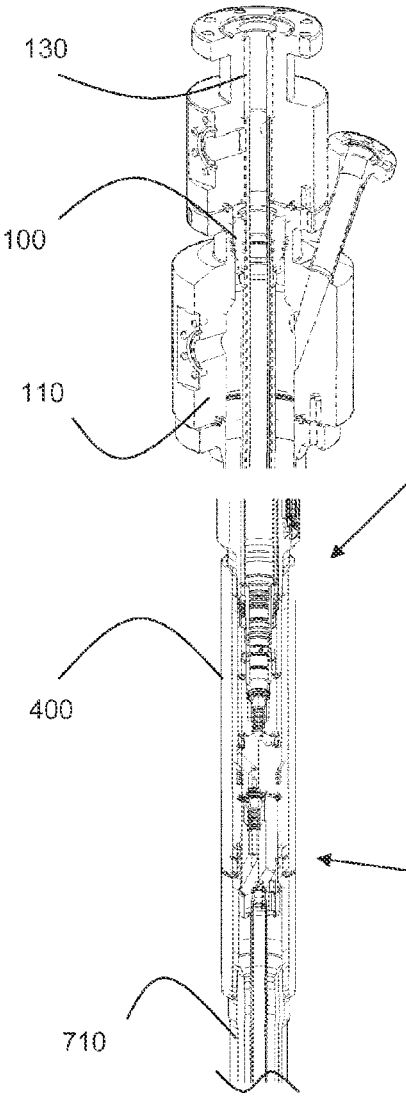
FIG. 14A is a quarter-sectional and elevation view of a further step according to FIG. 13, more particularly illustrating the insertion of the intermediate tubing string, hanging the tubing from an intermediate tubing hanger, latching of the intermediate mandrel and positioning of the oxygen passageway within the burner housing.
Figure 14B:
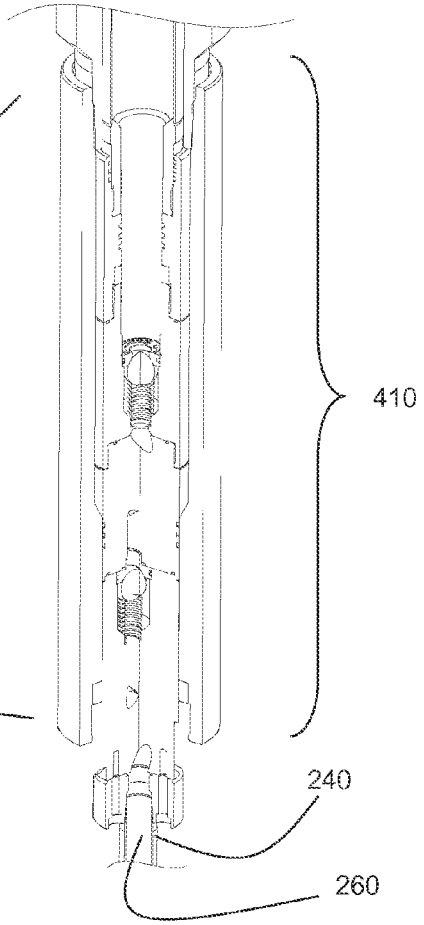
FIG. 14B is a closeup of the burner interface assembly of FIG. 14A for illustrating the intermediate tubing, the intermediate mandrel and the oxygen passageway.

Referring to FIG. 14B, an intermediate tubing hanger 130 is supported on the main tubing hanger 100. With reference to FIGS. 14A and 14B, the intermediate mandrel 410 is fluidly connected to a downhole end of the intermediate tubing string 120, and the concentric tubing 240 defining the oxygen passageway 260 extends downhole from the intermediate mandrel 410. As shown in FIG. 14B, the intermediate tubing string 120 is run downhole within the bore of the main tubing string 40. The intermediate mandrel 410 is run downhole until it is tagged with the outer housing 400 of the burner interface assembly 50. Tagging the intermediate mandrel 410 to the outer housing 400 involves releaseably connecting the outer housing 400 to the intermediate mandrel 410 at the intermediate latch assembly 470, forming the intermediate annulus 140 therebetween. The intermediate tubing string 120 is pulled uphole to stretch the intermediate tubing 120 and remove any slack. The intermediate tubing string 120 is hung by the intermediate tubing hanger 130 and then cut to an appropriate length.

Figures 15A, 15B:
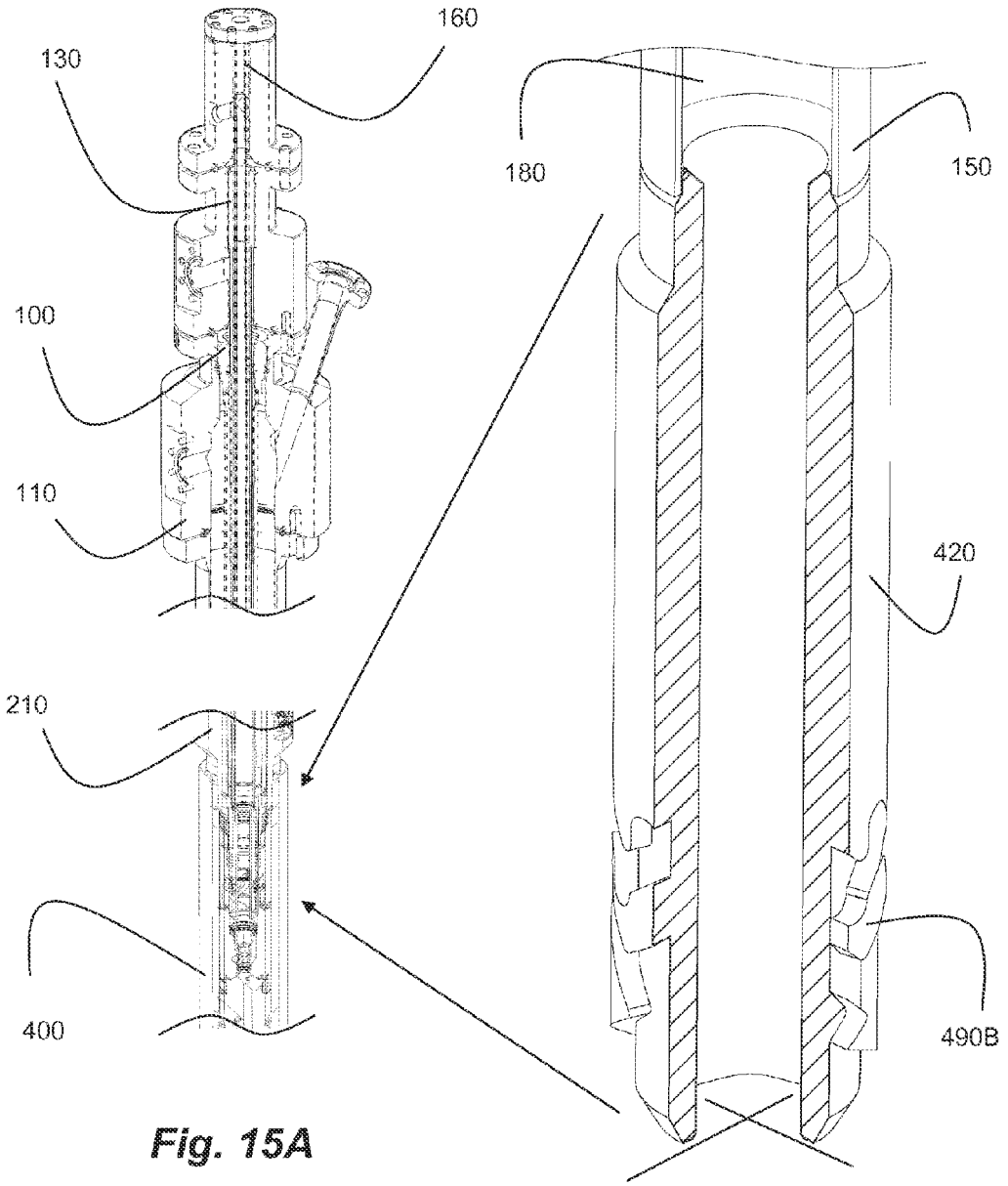
FIG. 15A is a quarter-sectional and elevation view of a further step according to FIG. 13, more particularly illustrating the insertion of the inner tubing string, hanging the inner tubing from an inner tubing hanger, latching of the inner mandrel.
FIG. 15B is a closeup of the burner interface assembly of FIG. 15A for illustrating the hanging the inner tubing from the inner tubing hanger, the inner tubing and the inner mandrel.

With reference to FIG. 15A, an inner tubing hanger 160 is supported on the intermediate tubing hanger 130. The inner mandrel 420 of the burner interface assembly 50 is fluidly connected to a downhole end of the inner tubing string 150, and run downhole within the intermediate bore of the intermediate tubing string 120. The inner tubing string 150 is run downhole until the inner mandrel 420 tags the intermediate mandrel 410 forming the inner annulus 170. Tagging the inner mandrel 420 to the intermediate mandrel 410 involves releaseably connecting the inner mandrel 420 to the intermediate mandrel 410 at the inner latch assembly 490. The inner tubing 150 is pulled uphole to stretch the inner tubing 150, hung by the inner tubing hanger 160 and then cut to an appropriate length. The bore of the inner tubing string 150 defines the inner bore 180.

The intermediate annulus 140 can be fluidly connected to a source of fuel, and the inner bore 180 can be fluidly connected to a source of oxidant, such as oxygen. The inner annulus 170 is sealed and is monitored. Any changes with the pressure within the sealed inner annulus 170 are indicative of a leak in either the intermediate annulus 140 or the inner bore 180.

A further utility of the backpressure valve assembly is to assure successful latching and continuity of the intermediate and inner tubing string at the burner interface assembly, an inability of the either passageway to retain pressure up to the opening pressure of the valves being indicative of a problem in the connections of one form or another.

The fuel can be delivered down the intermediate annulus 140 passing through the first bypass passageway 610 and first backpressure valve 620 and to the fuel passageway 250. Similarly, oxygen can be injected down the inner bore 180, through the second bypass passageway 630 and the second backpressure valve 640 to the oxygen passageway 260. Both the fuel and oxygen enter the nozzle 200 for combustion. The first and second backpressure valves 620, 640 creates a backpressure greater than that static head to surface pressure, ensuring that the flow of the fuel and oxygen can be controlled from the surface by controlling the flow rate of the fuel and oxygen. If the flow rate of the fuel or oxygen does not create enough pressure to overcome the pressure exerted by the closing force of the backpressure valve spring 620B, 640B and the reservoir pressure, fuel and oxygen cannot pass the first and second backpressure valves 620, 640.

After the burner assembly 20 is positioned within the target zone, the reservoir 10 can be initially flooded with water. Water is injected down the casing annulus 80 to enter the reservoir 10 through the perforations for increasing the reservoir pressure adjacent the wellbore. The fuel is then injected downhole. After a sufficient amount of time to ensure that the fuel has entered the target zone downhole, the fuel is doped with an accelerant, a pyrophoric compound such as triethylborane or silane, sufficient for igniting the fuel. Oxygen is injected to light off the downhole burner 60. The accelerant is discontinued to create a stable flame for combustion. A stable flame can be maintained by controlling the rate of the fuel and oxygen. The fuel and oxygen are controlled to combust at a temperature to create a combustion cavity 30 sufficient to melt or otherwise form a cavity 30.

In one embodiment, the downhole burner 60 can be lit off and operated at a first condition to form a minimum stable flame temperature of about 2800° C. At such a temperature, it is believed that the casing 90 and the surrounding reservoir 10 downhole of the burner 60 would melt, forming the combustion cavity 30. The burner 60 is then located or arranged generally uphole of the cavity. As the combustion cavity 30 expands, molten material will flow and pool at a bottom of the combustion cavity 30 above the thermal cement for forming an impermeable glassy bottom. Further, the heat from the flame continues to be transferred to the lateral walls by a combination of radiant heat transfer and hot combustion gases permeating into the reservoir 10. Melting and enlargement of the combustion cavity 30 ceases when the combustion cavity 30 is sufficiently large enough that the heat transfer from the combustion is below the melting point of the reservoir 10. The lateral walls of the combustion cavity 30 remain porous and permeable, perhaps in a sintered state.

Once the combustion cavity 30 has been formed, the fuel and oxygen are controlled to continue steady state combustion for creating and sustaining hot combustion gases for flowing and permeating into the target zone.

Further, the steady state combustion of the fuel and oxygen is also under sub-stoichiometric conditions, limiting the amount of oxygen available for combusting with the fuel. The limited amount of available oxygen ensures that there is no excess oxygen available for flowing into the reservoir 10. Excess oxygen flowing into the reservoir 10 may result in additional combustion within the reservoir 10 and result in some coking therein.

Water is delivered down the casing annulus 80. The casing seal 70 directs the water out the perforations and into the target zone concurrently as hot combustion gases are created and sustained at steady state. The injected water and hot combustion gases in the target zone interact to form a drive front comprising steam and hot combustion gases.

The present process further protects the reservoir 10 from permeability degradation due to chloride scaling by keeping the chlorides in solution. Most chloride scaling is caused by introducing water with a dissimilar ion charge during water flooding. Increasing temperature and/or pressure typically improves solubility of chlorides. The risks of chlorides deposition are reduced as both temperature and pressure increase with the introduction of heat and $CO_2$ (from the hot combustion gases). Higher $CO_2$ concentrations in formed emulsion increases carbonate solubility. The process can be operated to continually produce incremental $CO_2$, gradually increasing concentrations as the flood progresses.

Risk of chloride scaling is further mitigated by maintaining an 80% steam quality downhole which keeps chlorides in solution. Untreated produced water typically contains upwards of 50,000 ppm of total dissolved solids, which is typically treated prior to being passed through boilers for conventional stem flood processes. Control of the mass and heat balance of the combustion process permits management of the steam generation in the target zone to be at about 80% steam quality. The lower steam quality ensures that there is a sufficient water phase to keep all dissolved solids in solution and treatment of the produced water is not required.

In an alternate embodiment, fuel can be injected downhole through the inner bore 180, while the oxygen can be injected down through the intermediate annulus 140.

Further, in an alternate embodiment, where regulation may prohibit injection of fluid down the casing annulus 80, water can be injected down one o the other passageways. For example, water could be injected down the intermediate annulus 140 for injection at the burner assembly for communication with the hydrocarbon reservoir. In such an embodiment, the inner annulus 170 can be used to inject fuel or oxygen, instead of being used as a sensing annulus for detecting leaks, oxygen or fuel could continue to be injected down in the inner bore 180. Further, as those skilled in the art would understand, the intermediate annulus 140 would have a water injection port in the burner assembly and placed in fluid communication with the reservoir to allow the injected water to flow into and permeate through the reservoir and a flow through packer can be used to isolate the burner assembly 20. One approach is to locate a flow-through packer at about the burner assembly for sealing the casing annulus above the water injection port. Water injected from the intermediate annulus would exit from the water injection port and into an injection annulus formed in the casing annulus between the packer and the casing seal.

Further still, yet, in a further alternate embodiment, the inner tubing string 150 can be eliminated such as to reduce costs. In such an embodiment, the main tubing string 40 can be disposed within the casing 90 forming the casing annulus 80, and the intermediate tubing string 120 can be disposed in the main tubing string 40 forming the intermediate annulus 140. The intermediate tubing string 120 would have a bore forming the inner bore 180. This embodiment would not have the inner annulus 170 to serve as a sensing annulus for detecting leaks in the intermediate annulus 140 and/or the inner bore 180.

The embodiments of the invention for which an exclusive property or privilege is claimed are defined as follows:

1. A process for creating a drive front in a hydrocarbon reservoir for enhanced oil recovery comprising:

accessing a cavity within the hydrocarbon reservoir with a wellbore;

arranging a burner assembly in the wellbore uphole of the cavity;

creating hot combustion gases with the burner assembly, directing the hot combustion gases from the burner assembly into the cavity and sustaining hot combustion gases therein;

injecting water into the hydrocarbon reservoir uphole of the cavity, the water entering into and permeating into the hydrocarbon reservoir and interacting with the hot combustion gases therein for creating steam in the hydrocarbon reservoir; and forming a steam drive front in the hydrocarbon reservoir.

2. The process of claim 1 further comprising artificially creating the cavity in the hydrocarbon reservoir.

3. The process of claim 2 wherein creating the artificially-created cavity comprises extending a combustion zone of the burner assembly into the cavity.

4. The process of claim 2 wherein creating the artificially-created cavity comprises forming an interface area between the hot combustion gases from the burner assembly and the hydrocarbon reservoir.

5. The process of claim 2 wherein creating the artificially-created cavity comprises mechanically-forming the cavity.

6. The process of claim 5 wherein creating the mechanically-created cavity comprises reaming the target zone.

7. The process of claim 5 wherein creating the mechanically-created cavity comprises accessing the target zone with a wellbore;

running a reaming tool downhole of the wellbore; and actuating the reaming tool and reaming the target zone to form the cavity.

8. The process of claim 2 wherein creating the artificially-created cavity comprises hydraulic washing of the target zone.

9. The process of claim 2 wherein creating the artificially-created cavity comprises accessing the target zone with a wellbore;

running a washing tool downhole of the wellbore; and actuating the washing tool for hydraulic washing the target zone to form the cavity.

10. The process of claim 2 wherein creating the artificially-created cavity comprises reaming the hydrocarbon reservoir downhole of the wellbore; and actuating a washing tool for hydraulic washing the reamed hydrocarbon reservoir to form the cavity.

11. The process of claim 2 wherein creating the artificially-created cavity comprises:

operating the burner assembly at a first condition for directing combustion into wellbore to form the cavity.

12. The process of claim 11 further comprising:

operating the burner assembly at a second condition for directing combustion into the created cavity to form the hot combustion gases.

13. The process of claim 1 wherein the cavity is a pre-existing cavity comprising:

accessing the pre-existing cavity with a wellbore; and running the burner assembly down the wellbore to access the cavity.

14. The process of claim 13 wherein the pre-existing cavity is a naturally-forming cavity.

15. The process of claim 13 wherein the hydrocarbon reservoir is a Cold Heavy Oil Production with Sand (CHOPS) reservoir and prior to arranging the burner assembly comprising producing from the wellbore and forming the pre-existing cavity in the hydrocarbon reservoir thereabout.

16. The process of claim 1 wherein injecting water into the hydrocarbon reservoir further comprises injecting water from a wellbore annulus between the burner assembly and the wellbore.

17. The process of claim 16 further comprising:

sealing the wellbore annulus with an annular seal at about the burner assembly; and wherein the injecting water from the annulus further comprises injecting water into the target zone uphole of an annular seal.

18. The process of claim 1 wherein the burner assembly further comprises a shroud disposed at a downhole end of the burner assembly and surrounding a combustion zone thereof, and wherein the injecting water from the wellbore annulus further comprises injecting water into the hydrocarbon reservoir from about the shroud.

* * * * *